US008267397B2

(12) United States Patent
Shimazu et al.

(10) Patent No.: US 8,267,397 B2
(45) Date of Patent: Sep. 18, 2012

(54) RECORDING MATERIAL FEEDING DEVICE, RECORDING APPARATUS AND LIQUID EJECTING APPARATUS

(75) Inventors: Masamitsu Shimazu, Matsumoto (JP); Yutaka Nakamura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 51 days.

(21) Appl. No.: 12/712,850

(22) Filed: Feb. 25, 2010

(65) Prior Publication Data

US 2010/0148427 A1 Jun. 17, 2010

Related U.S. Application Data

(62) Division of application No. 11/835,212, filed on Aug. 7, 2007, now Pat. No. 7,694,959.

(30) Foreign Application Priority Data

Aug. 8, 2006 (JP) ..... 2006-215656
Aug. 7, 2007 (JP) ..... 2007-204924

(51) Int. Cl.
*B65H 1/00* (2006.01)

(52) U.S. Cl. ..... 271/171; 271/145; 399/393

(58) Field of Classification Search ..... 271/171, 271/145; 399/393

See application file for complete search history.

(56) References Cited

U.S. PATENT DOCUMENTS

| | | | |
|---|---|---|---|
| 5,931,456 | A | 8/1999 | Laidlaw |
| 7,527,259 | B2 | 5/2009 | Meetze, Jr. et al. |
| 2004/0070138 | A1 | 4/2004 | Ishikuro |

FOREIGN PATENT DOCUMENTS

| | | | | |
|---|---|---|---|---|
| JP | 06-082053 | U | | 11/1994 |
| JP | 07-285681 | | | 10/1995 |
| JP | 2002-255360 | | | 9/2002 |
| JP | 2002255359 | A | * | 9/2002 |
| JP | 2002-255360 | A | | 11/2002 |
| JP | 2004-106973 | A | | 4/2004 |
| JP | 2005015105 | A | * | 1/2005 |
| JP | 2006-008351 | A | | 1/2006 |

* cited by examiner

*Primary Examiner* — Luis A Gonzalez
(74) *Attorney, Agent, or Firm* — Workman Nydegger

(57) ABSTRACT

A recording material mounting face portion is provided on which recording materials are stacked for being fed. A body slide portion is attached to the recording material mounting face portion to be slidable in a widthwise or a feeding direction of the recording material. A movable edge guide includes a body operating portion having a guide face that contacts a side of the recording material while being fed and a fixing means that fixes a position of the movable edge guide in a slide direction of the movable edge guide. The fixing means includes notch columns on a surface of the recording material mounting face portion along the slide direction of the movable edge guide and engaging protrusions on the movable edge guide and that engage notches of the notch columns to realize the fixed state.

9 Claims, 19 Drawing Sheets

RECORDING MATERIAL FEEDING DEVICE, RECORDING APPARATUS AND LIQUID EJECTING APPARATUS

CROSS-REFERENCE TO A RELATED APPLICATION

This application is a divisional of U.S. patent application Ser. No. 11/835,212 filed Aug. 7, 2007 which claimed priority to Japanese Patent Application Number 2006-215656 filed Aug. 8, 2006 and Japanese Patent Application Number 2007-204924 filed Aug. 7, 2007. The entire disclosures of these applications are expressly incorporated herein by reference.

BACKGROUND

The present invention relates to a recording material feeding device that includes a recording material mounting face portion on which recording materials are stacked for being fed, a body slide portion that is attached to the recording material mounting face portion so as to be slidable in a widthwise direction or in a feeding direction of the recording material, a movable edge guide that includes a body operating portion having a guide face that contacts a side of the recording material while being fed and a fixing means that fixes a position of the movable edge guide in a slide direction of the movable edge guide, and also to a recording apparatus provided with the recording material feeding device.

Furthermore, the invention also relates to a liquid ejecting apparatus, such as an ink jet recording apparatus, that performs ejection onto a liquid ejected target material by discharging liquid, such as ink, from its head.

Here, the liquid ejecting apparatus not only includes a recording apparatus, such as a printer, a copying machine and a facsimile, which uses an ink jet recording head and discharges ink from the recording head to a recording material to perform recording but also includes an apparatus that ejects liquid corresponding to its purpose instead of ink from a liquid ejecting head, which corresponds to the recording head, to a liquid ejected target material corresponding to the recording material to attach the liquid to the liquid ejected target material.

In addition to the recording head, the liquid ejecting head can be a color material ejecting head used for manufacturing a color filter for a liquid crystal display, an electrode material (conductive paste) ejecting head used for forming an electrode for an organic EL display or a field emission display (FED), a bio-organic material ejecting head used for manufacturing a bio-chip, or a sample ejecting head that ejects a sample as a precision pipette.

An existing recording material feeding device of this type, that is, an existing recording material feeding device that includes a recording material mounting face portion on which recording materials are stacked for being fed, a body slide portion that is attached to the recording material mounting face portion so as to be slidable in a widthwise direction of the recording material, a movable edge guide that includes a body operating portion having a guide face that contacts a side of the recording material to guide feeding and a fixing means that fixes a position of the movable edge guide in a slide direction of the movable edge guide is disclosed in Japanese Patent No. 2906995 and Japanese Unexamined Patent Application Publication No. 2002-255360.

The fixing means includes a notch column that is provided on a surface of the recording material mounting face portion along the slide direction of the movable edge guide and an engaging protrusion that is provided on the movable edge guide and that engages a notch of the notch column to realize the fixed state. Then, the engaging protrusion is disengaged from the notch by pressing an operating portion with a finger, the movable edge guide is moved in the widthwise direction, and, when the guide face of the movable edge guide contacts the side of the recording material, the engaging protrusion is engaged with the notch and fixed to the position by separating the finger from the operating portion. Thus, the position of the side of the recording material is regulated.

However, the pitch of each notch forming the notch column, that is, the resolution, has a minimum pitch on the basis of the limit of its manufacturing technology; the notch column could not be formed in the resolution of pitch that is further smaller than the minimum pitch. Specifically, at present, it is difficult to form the notch column at a pitch of 1 mm or below. For this reason, the resolution of positioning of the side of the recording material is limited to 1 mm, and it has been difficult to position the side thereof with a further fine resolution. However, in order to realize a further improvement of recording quality, it has been desired to provide a recording material feeding device that is able to feed a recording material by positioning the recording material with a high resolution that exceeds the limit of manufacturing technology for the notch column.

DISCLOSURE OF INVENTION

The invention is contemplated in light of the above background, and it is an object of the invention to provide a recording material feeding device that can realize positioning of a recording material with a high resolution that exceeds the limit of manufacturing technology for a notch column and thereby can realize a further improvement of recording quality, also to provide a recording apparatus having the recording material feeding device, and further to provide a liquid ejecting apparatus.

To achieve the above object, a first aspect of the invention provides a recording material feeding device that includes a recording material mounting face portion on which recording materials are stacked for being fed, a movable edge guide that includes a body slide portion that is attached to the recording material mounting face portion so as to be slidable in a widthwise direction or in a feeding direction of the recording material, and a body operating portion having a guide face that contacts a side of the recording material while being fed and a fixing means that fixes a position of the movable edge guide in a slide direction of the movable edge guide, wherein the fixing means includes notch columns that are provided on a surface of the recording material mounting face portion along the slide direction of the movable edge guide and engaging protrusions that are provided on the movable edge guide and that engage notches of the notch columns to realize the fixed state, wherein a plurality of the notch columns are formed, each of the notch columns is formed to have the notches at the same pitch, wherein the engaging protrusions are provided separately for the respective notch columns, while the engaging protrusions are located at the same position in the slide direction, and wherein the recording material feeding device is configured according to any one of a combination in which at least two of the notch columns are offset in phase and a combination in which all of the notch columns are the same in phase and at least two of the engaging protrusions are offset in position in the slide direction.

In the first aspect of the invention, the operation and advantageous effects of the structure of combination in which the engaging protrusions are located at the same position in the slide direction and at least two of the notch columns are offset in phase are described as follows.

Thus, even when the notch columns are formed in a "minimum pitch" of manufacturing limit, the pitch between the notch columns that are offset in phase from each other becomes further smaller than the "minimum pitch" by that phase offset, so that the plurality of notch columns as a whole have notch columns with further high resolution that exceeds the "minimum pitch" of manufacturing limit.

Then, the engaging protrusions are provided separately for the respective notch columns, and the engaging positions of the engaging protrusions are side by side at the same positions. Thus, one fixed position in which a portion of the engaging protrusions firmly engage(s) the notch(es) of the opposed notch column(s) while the other engaging protrusion (s) cannot be engaged with the notch(es) of the opposed notch column(s) and the other fixed position in which the portion of the engaging protrusion(s) cannot be engaged with the notch (es) of the opposed notch column(s) while the other engaging protrusion(s) can firmly engage the notch(es) of the opposed notch column(s) are performed by the unit of the offset in phase.

As described above, according to the first aspect of the invention, it is possible to feed a recording material by positioning the recording material with a high resolution that exceeds the limit of manufacturing technology for the notch column and thereby it is possible to realize a further improvement of recording quality.

In addition, the operation and advantageous effects of the structure of the other combination, that is, all of the notch columns are the same in phase and at least two of the engaging protrusions are offset in position in the slide direction, are basically the same as those of the structure of the above described combination because the phase offset in the notch columns is replaced by the position offset in the engaging protrusions.

That is, in the structure in which the positions of the engaging protrusions are offset, the pitch becomes further smaller than the "minimum pitch" by that position offset amount, so that, for the plurality of notch columns as a whole, it is possible to feed a recording material by positioning the recording material with a high resolution that exceeds the manufacturing limit "minimum pitch".

A second aspect of the invention provides the recording material feeding device according to the first aspect, wherein the notch columns are formed of three columns in which the outside two notch columns are formed to be in the same phase and the inside notch column is formed to be in phase that is offset from the outside notch columns, or the outside two engaging protrusions are located at the same position in the slide direction and the inside engaging protrusion is located at a position that is offset from the outside engaging protrusions.

According to the second aspect of the invention, in addition to the operation and advantageous effects of the first aspect, it is possible to obtain the operation and advantageous effects thereof with a simple structure. In view of that point, the amount of phase offset of the notch columns or the amount of position offset of the engaging protrusions is preferably a half pitch (½ pitch) of the "minimum pitch" that is determined depending on manufacturing technology.

A third aspect of the invention provides the recording material feeding device according to the second aspect, wherein the outside notch columns have the same width, and the inside notch column has twice the width as the outside notch columns.

According to the third aspect, in addition to the operation and advantageous effects of the second aspect, the following operation and advantageous effects are obtained. By forming the length of the engaging protrusion on the basis of the same relationship as the above "twice" (the relationship in which the length of the inside engaging protrusion is twice the length as the outside one), even when any engaged state between an engaged state in which an engagement is performed using the outside notch column and an engaged state in which an engagement is performed using the inside notch column, the length of contact between the engaging protrusion and the notch may be made equal, so that the fixing force also becomes substantially equal, and, hence, it is possible to ensure the reliability and stability of edge guide operation.

A fourth aspect of the invention provides the recording material feeding device according to any one of the first to third aspects, wherein a portion at which the phase of each notch column is offset, when the notch column that extends over the entire length of an area, in which the movable edge guide is moved, is defined as a base column, is provided at a portion of an area of the base column.

According to the fourth aspect of the invention, in addition to the operation and advantageous effects of any one of the first to third aspects, the following operation and advantageous effects are obtained. The portion at which the phase of each notch column is offset, when the notch column that extends over the entire length of the area, in which the movable edge guide is moved, is defined as a base column, is provided at a portion of an area of the base column, so that it is possible to increase the resolution of only the portion of an area that is frequently used and, hence, it becomes a simple structure.

A fifth aspect of the invention provides the recording material feeding device according to any one of the first to fourth aspects, wherein the engaging protrusions of the movable edge guide are respectively provided on free end sides of separated elastic pieces that are separated by providing slits in a plate-like portion of the body slide portion, and wherein the movable edge guide further includes an engaging/disengaging means that switches between an engaged state in which the engaging protrusions are engaged with the notches and a disengaged state in which the engaging protrusions are disengaged from the notches by applying force that bends the separated elastic pieces.

According to the fifth aspect of the invention, in addition to the operation and advantageous effects of any one of the first to fourth aspects, the following operation and advantageous effects are obtained. Because the separated elastic pieces are formed using the slits, and the "engaged state" and the "disengaged state" are configured to be switched so that the separated elastic pieces are bent by the engaging/disengaging means against the elastic force, it is possible to perform an operation to slide the movable edge guide for adjusting to the width of a recording material and an operation to fix the position of the movable edge guide with high operability.

A sixth aspect of the invention provides the recording material feeding device according to the fifth aspect, wherein the separated elastic pieces are set to apply the same urging force that presses the engaging protrusions against the notches, and wherein the engaging protrusions are set so that the engaging protrusions have the same width.

According to the sixth aspect of the invention, because the engaging protrusions of the movable edge guide are set to apply the same urging force that presses the engaging protrusions against the notches, and the engaging protrusions have the same width, the engaging characteristics with the opposed notch columns are the same between the outside engaging protrusions and the inside engaging protrusion. Thus, in addition to the operation and advantageous effects of the fifth aspect, it is possible to reduce the possibility that the engaging characteristics with the notch columns between the outside engaging protrusions and the inside engaging protrusion tends to be unbalanced and to make it the same, and, hence, it is possible to improve operability.

A seventh aspect of the invention provides the recording material feeding device according to the fifth aspect, wherein the separated elastic pieces are set to apply such elastic forces of the separated elastic pieces that the amount of engagement by which the engaging protrusion is engaged with the notch becomes equal between both position fixed states, that is, one position fixed state in which a portion of the engaging protrusion(s) engage(s) the notch(es) and the other engaging protrusion(s) cannot engage the notch(es) and the other position fixed state in which a portion of the engaging protrusion (s) cannot engage the notch(es) and the other engaging protrusion(s) engage(s) the notch(es).

The separated elastic piece(s) having the engaging protrusion(s), which is/are located at the position(s) that cannot engage the notch(es), at its/their distal end(s) is/are forcibly bent in the reverse direction against the urging force(s) of the separated elastic piece(s), so that reaction force is generated on the basis of the forcibly bent deformation. Because the reaction force acts in a direction in which the bent deformation is reduced, the reaction force is applied in a direction in which the other engaging protrusion(s) that is/are engaged with the notch(es) is/are disengaged from the engaged position(s). Depending on the relationship in magnitude between the force acting in the disengaging direction and the urging force, there is a possibility that the engaging force of the engaging protrusion with the notch becomes unstable and the engaging protrusion then comes off from the notch.

However, according to this aspect, the elastic forces of the separated elastic pieces is set so that the amount of engagement by which the engaging protrusion engages the notch becomes equal in both position fixed states, so that, in addition to the operation and advantageous effects of the fifth aspect, it is possible to reduce the possibility that the engaging force of the engaging protrusion with the notch, when the engaging protrusion is located at the engaged position, becomes unstable due to the reaction force and, thereby, it is possible to reliably make the engaging protrusion be engaged with the notch.

An eighth aspect of the invention provides the recording material feeding device according to the sixth aspect, wherein the engaging protrusions of the movable edge guide are formed so that the engaging protrusion(s) that engage(s) the notch(es) in smaller number is/are formed longer in projecting size than the engaging protrusion(s) that engage(s) the notch(es) in larger number.

When the urging force that presses the engaging protrusions against the notches are set equal and the engaging protrusions are formed to have the same width, the magnitude of reaction force based on forcibly bent deformation differs between a small-number engaged state (that is, a large-number non-engaged state) in which the engaging protrusion(s) engage(s) the notch(es) in small number and a large-number engaged state (that is, a small-number non-engaged state) in which the engaging protrusions engage the notches in large number. The small-number engaged state, that is, the large-number non-engaged state, generates larger reaction force. Therefore, in the engaging protrusion(s) located at the engaged position(s) in that state, the engaging force(s) of the engaging protrusion(s) with the notch(es) becomes unstable due to the action of the large reaction force and, hence, there is a possibility that the engaging protrusion comes off from the notch.

However, according to the present aspect, the above engaging protrusions are formed so that the engaging protrusion(s) that engage(s) the notch(es) in the small-number engaged state is/are formed longer in projecting size than the other engaging protrusions that engage the notches in the large-number engaged state, so that, by absorbing the influence of the reaction force with the difference in the projecting size, it is possible to reduce the possibility that the engaging force(s) of the engaging protrusion(s) with the notch(es) becomes unstable and, thereby, it is possible to reliably make the engaging protrusion be engaged with the notch.

An eighth aspect of the invention provides the recording material feeding device according to the sixth aspect, wherein the engaging protrusions of the movable edge guide are formed so that the engaging protrusion(s) that engage(s) the notch(es) in smaller number is/are formed longer in projecting size than the engaging protrusion(s) that engage(s) the notch(es) in larger number.

When the urging force that presses the engaging protrusions against the notches are set equal and the engaging protrusions are formed to have the same width, the magnitude of reaction force based on forcibly bent deformation differs between a small-number engaged state (that is, a large-number non-engaged state) in which the engaging protrusion(s) engage(s) the notch(es) in small number and a large-number engaged state (that is, a small-number non-engaged state) in which the engaging protrusions engage the notches in large number. The small-number engaged state, that is, the large-number non-engaged state, generates larger reaction force. Therefore, in the engaging protrusion(s) located at the engaged position(s) in that state, the engaging force(s) of the engaging protrusion(s) with the notch(es) becomes unstable due to the action of the large reaction force and, hence, there is a possibility that the engaging protrusion comes off from the notch.

However, according to the present aspect, the above engaging protrusions are formed so that the engaging protrusion(s) that engage(s) the notch(es) in the small-number engaged state is/are formed longer in projecting size than the other engaging protrusions that engage the notches in the large-number engaged state, so that, by absorbing the influence of the reaction force with the difference in the projecting size, it is possible to reduce the possibility that the engaging force(s) of the engaging protrusion(s) with the notch(es) becomes unstable and, thereby, it is possible to reliably make the engaging protrusion be engaged with the notch.

A ninth aspect of the invention provides the recording material feeding device according to the sixth aspect, wherein the notch columns are formed of odd-numbered columns, and wherein the engaging protrusions of the movable edge guide are configured so that the center engaging protrusion that corresponds to the center notch column located at the center among the odd-numbered notch columns is formed longer in projecting size than the other engaging protrusions.

In the ninth aspect of the invention, it is the small-number engaged state as described in the seventh aspect when the center engaging protrusion corresponding to the center notch column is located at an engaged position, while the plurality of other engaging protrusions located at both sides are in the disengaged state, that is, the large-number non-engaged state. Therefore, it receives a large reaction force as described in the seventh aspect; however, the center engaging protrusion is formed longer in projecting size than the other engaging protrusions. Thus, by absorbing the influence of the reaction force with the difference in the projecting size, it is possible to reduce the possibility that the engaging force(s) of the engaging protrusion(s) with the notch(es) becomes unstable and, thereby, it is possible to reliably make the engaging protrusion be engaged with the notch.

Note that, when the plurality of other engaging protrusions located at both sides are located at the engaged positions, the center engaging protrusion is in the disengaged state (non-engaged state), so that the separated elastic piece is slightly bent and deformed. The separated elastic piece of the center engaging protrusion applies small reaction force due to the bent deformation, so that its influence may be ignored.

A tenth aspect of the invention provides the recording material feeding device according to the fifth aspect, wherein the engaging/disengaging means includes a swing knob that is provided on the body operating portion, a hook portion that is provided on the swing knob, and a hooked portion that is provided on each of the separated elastic pieces and engaged with the hook portion, and wherein, when the swing knob is swung, the hook portion is configured to engage the hooked portions and applies force that bends the separated elastic pieces to realize the disengaged state.

According to the tenth aspect of the invention, in addition to the operation and advantageous effects of the fifth aspect, because, when the swing knob is swung, the hook portion is configured to engage the hooked portions and then applies force that bends the separated elastic pieces so as to realize the disengaged state, it is possible to simply perform switching between engagement and disengagement with a simple structure.

An eleventh aspect of the invention provides the recording material feeding device according to the fifth aspect, wherein an outer surface of the plate-like portion of the body slide portion is configured to function as a recording material mounting surface on which the recording materials are mounted, a guide salient portion that guides an end side portion, which is a distal end in an advancing direction when the recording material advances in the reverse direction at the time when the recording material is returned in the reverse direction of a transport direction, in a direction away from the outer surface of the plate-like portion is provided on the downstream side of the slit that is located at the most downstream side among the slits of the body slide portion.

The recording material may possibly be returned in the reverse direction of the transport direction in transport control. When the recording material is returned in the reverse direction after the end side portion of the recording material is fed up to the downstream side beyond the position of the movable edge guide, and if the recording material is the last one sheet, the rear face of the end side portion of the recording material is moved while directly rubbing the recording material mounting face. Thus, there is a possibility that a corner portion of the end side portion is caught by the slits.

According to the present aspect of the invention, in addition to the operation and advantageous effects of the fifth aspect, because a guide salient portion that guides an end side portion, which is a distal end in an advancing direction when the recording material advances in the reverse direction at the time when the recording material is returned in the reverse direction of the transport direction, in a direction away from the outer surface of the plate-like portion is provided, a corner portion of the end side portion of the recording material is guided in a direction away from the slits. Thus, it is possible to reduce the possibility that a corner portion is caught by the slits.

A twelfth aspect of the invention provides the recording material feeding device according to the eleventh aspect, wherein other guide salient portion(s) is/are provided on the downstream side(s) of the other slit(s).

According to the present aspect, because the other guide salient portion(s) is/are provided on the downstream side of the other slit(s) as well, the corner portion of the end side portion of the recording material is guided in a direction away from each of the slits, so that it is possible to further reduce the possibility that the corner portion is caught by the slits.

A thirteenth aspect of the invention provides the recording material feeding device according to the fifth aspect, wherein the slits are provided so as to be inclined relative to the slide direction.

According to the present aspect of the invention, in addition to the operation and advantageous effects of the fifth aspect, even if the corner portion of the end side portion of the recording material contacts the slits when the recording material is returned in the reverse direction of the transport direction, because the slits are provided so as to be inclined relative to the slide direction as described above, the inclination releases force by which the recording material is caught. Thus, a troublesome due to the catch hardly occurs.

A fourteenth aspect of the invention provides the recording material feeding device according to the thirteenth aspect, wherein the slits are inclined in such an orientation that the free end sides of the separated elastic pieces are positioned upstream in a transport direction of the recording material beyond proximal end sides of the separated elastic pieces.

According to the present aspect of the invention, in addition to the operation and advantageous effects of the thirteenth aspect, even if the corner portion of the end side portion of the recording material contacts the slits, the above oriented inclination stably releases force by which the recording material is caught. Thus, a troublesome due to the catch hardly occurs.

A fifteenth aspect of the invention provides a recording apparatus that includes a recording material feeding device and a record performing unit that performs recording on a recording material that is fed from the recording material feeding device, wherein the recording material feeding device includes a recording material mounting face portion on which recording materials are stacked for being fed, a movable edge guide that includes a body slide portion that is attached to the recording material mounting face portion so as to be slidable in a widthwise direction or in a feeding direction of the recording material, and a body operating portion having a guide face that contacts a side of the recording material while being fed and a fixing means that fixes a position of the movable edge guide in a slide direction of the movable edge guide, wherein the fixing means includes notch columns that are provided on a surface of the recording material mounting face portion along the slide direction of the movable edge guide and engaging protrusions that are provided on the movable edge guide and that engage notches of the notch columns to realize the fixed state, wherein a plurality of the notch column are formed, each of the notch columns is formed to have the notches at the same pitch, wherein the engaging protrusions are provided separately for the respective notch columns, while the engaging protrusions are located at the same position in the slide direction, and wherein the recording material feeding device is configured according to any one of a combination in which at least two of the notch columns are offset in phase and a combination in which all of the notch columns are the same in phase and at least two of the engaging protrusions are offset in position in the slide direction.

According to the recording apparatus, the same operation and advantageous effects of the first to fourteenth aspects may be obtained.

A sixteenth aspect of the invention provides a liquid ejecting apparatus that includes a liquid ejected target material feeding device and a liquid eject performing unit that performs liquid ejection on a liquid ejected target material that is fed from the liquid ejected target material feeding device, wherein the liquid ejected target material feeding device includes a liquid ejected target material mounting face portion on which liquid ejected target materials are stacked for being fed, a movable edge guide that includes a body slide portion that is attached to the liquid ejected target material mounting face portion so as to be slidable in a widthwise direction of the liquid ejected target material, and a body operating portion having a guide face that contacts a side of the liquid ejected target material while being fed and a fixing means that fixes a position of the movable edge guide in a slide direction of the movable edge guide, wherein the fixing means includes notch columns that are provided on a surface of the liquid ejected target material mounting face portion along the slide direction of the movable edge guide and engaging protrusions that are provided on the movable edge guide and that engage notches of the notch columns to realize the fixed state, wherein a plurality of the notch columns are formed, each of the notch columns is formed to have the notches at the same pitch, wherein the engaging protrusions are provided separately for the respective notch columns, while the engaging protrusions are located at the same position in the slide direction, and wherein the liquid ejected target material feeding device is configured according to any one of a combination in which at least two of the notch columns are offset in phase and a combination in which all of the notch columns are the same in phase and at least two of the engaging protrusions are offset in position in the slide direction.

DETAILED DESCRIPTION OF THE EMBODIMENTS

Hereinafter, embodiments of the invention will be described with reference to the accompanying drawings.

Figure 1:
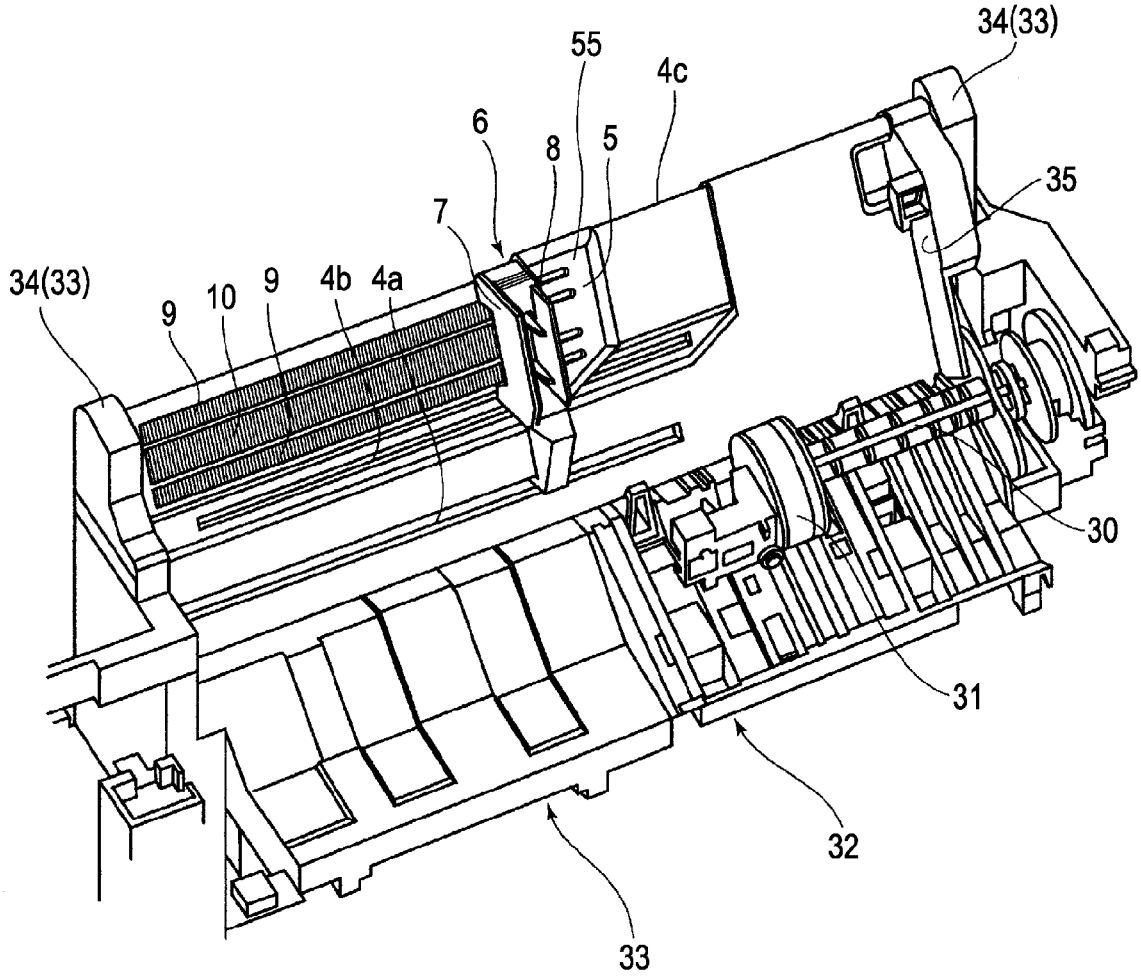
FIG. 1 is a perspective view, as viewed from the upper left side, showing one embodiment of a recording material feeding device that forms an ink jet recording apparatus, which is one example of a recording apparatus according to the invention.
Figure 2:
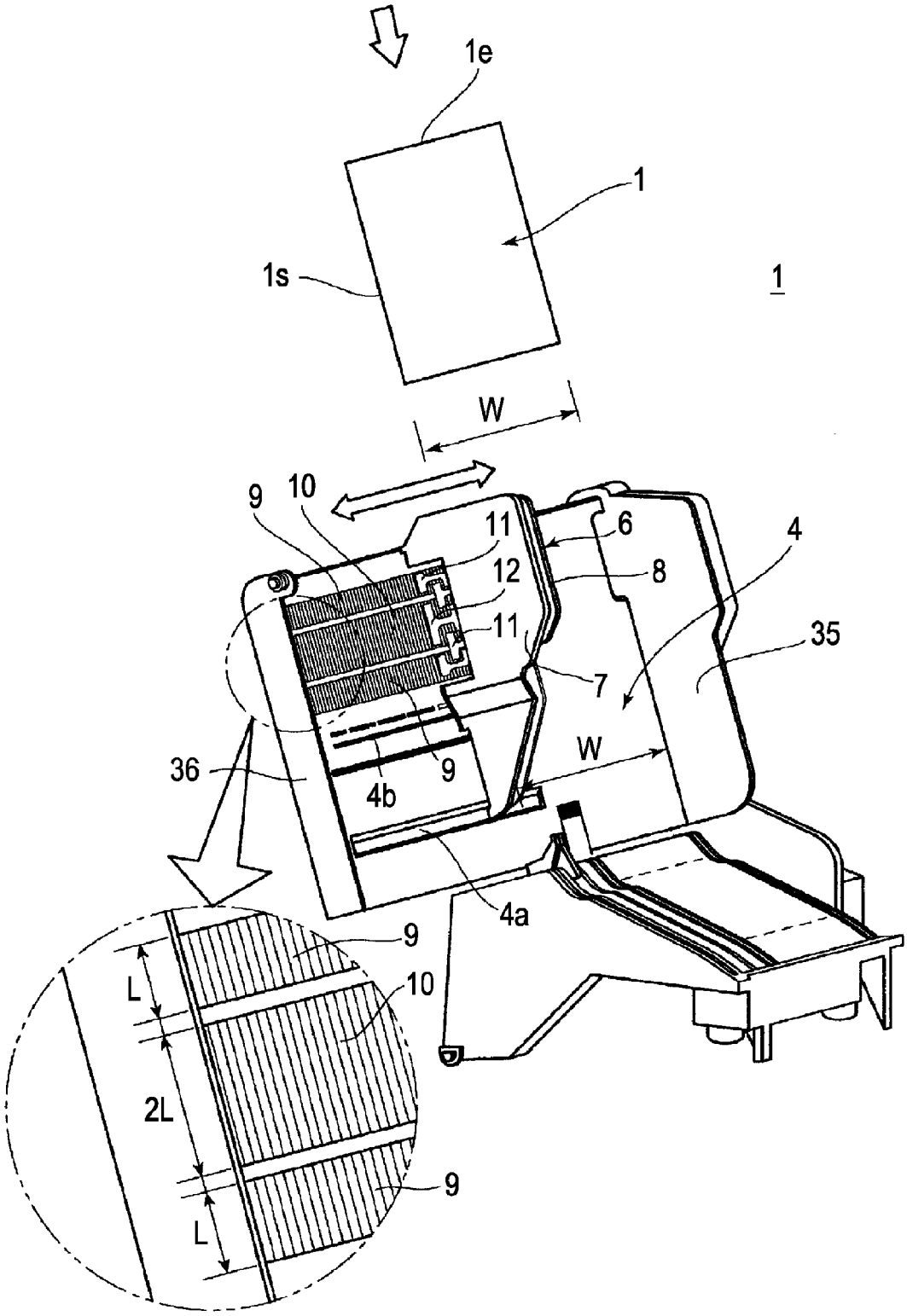
FIG. 2 is a perspective view of a relevant part of the device, including an enlarged view of a relevant part, as viewed from the upper left side lower than the viewpoint of FIG. 1.
Figure 3:
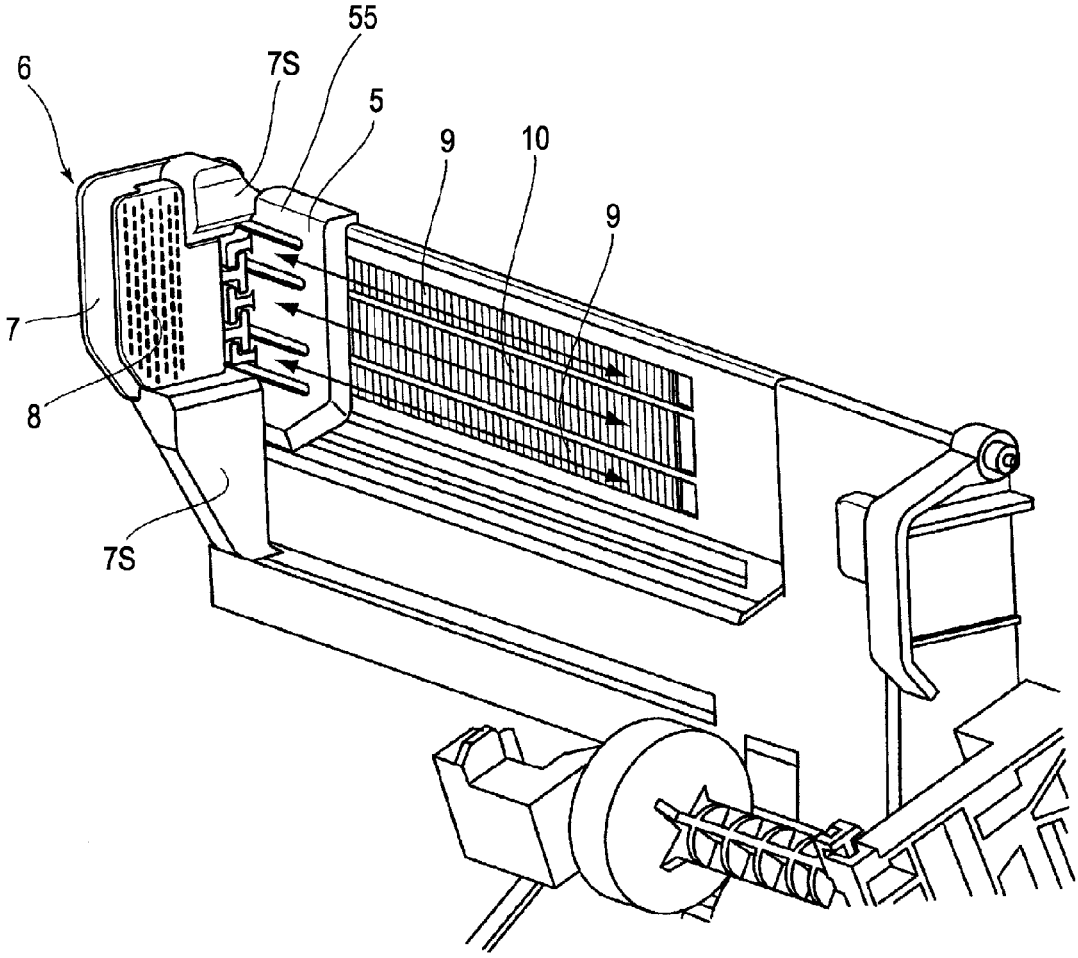
FIG. 3 is a perspective view of a relevant part of the device, as viewed from the upper right side.
Figure 4:
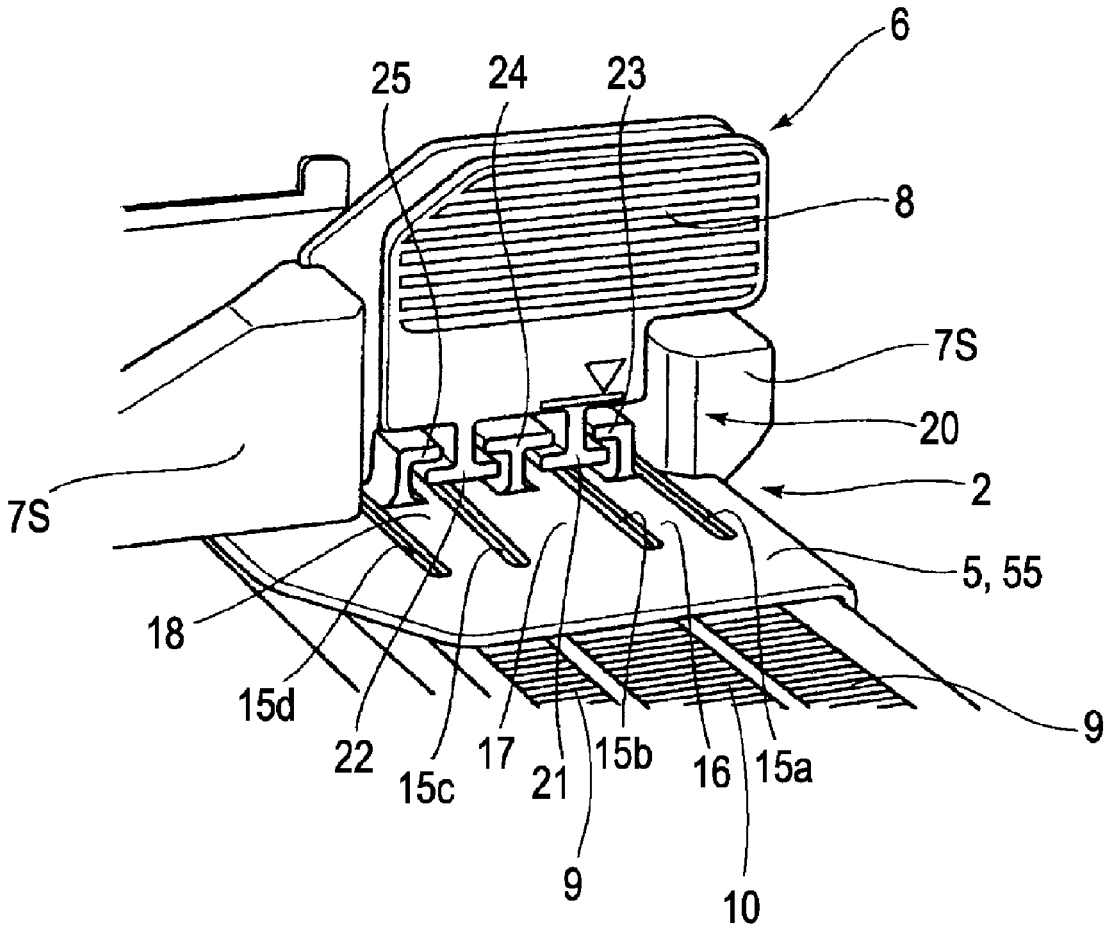
FIG. 4 is an enlarged perspective view of a movable edge guide which is in a fixed state according to the present embodiment.
Figure 5:
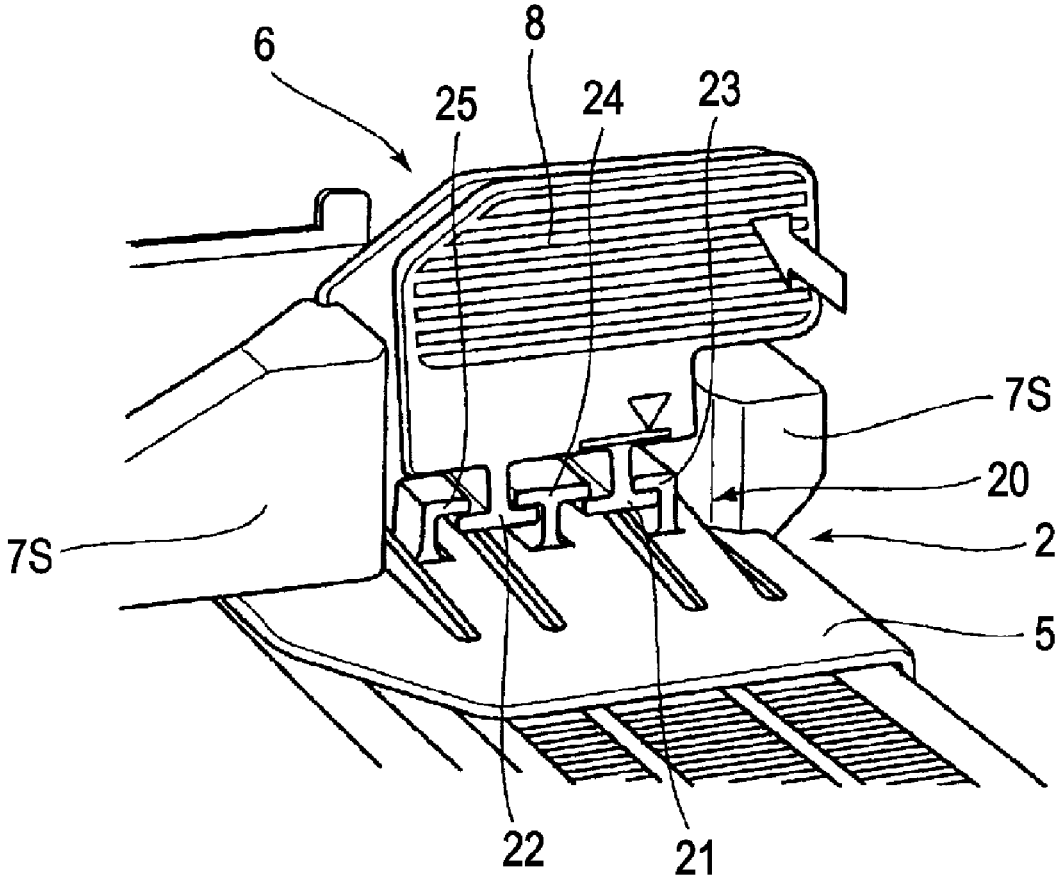
FIG. 5 is an enlarged perspective view of the movable edge guide which is released from the fixed state and in a slidable state according to the present embodiment.
Figure 6:
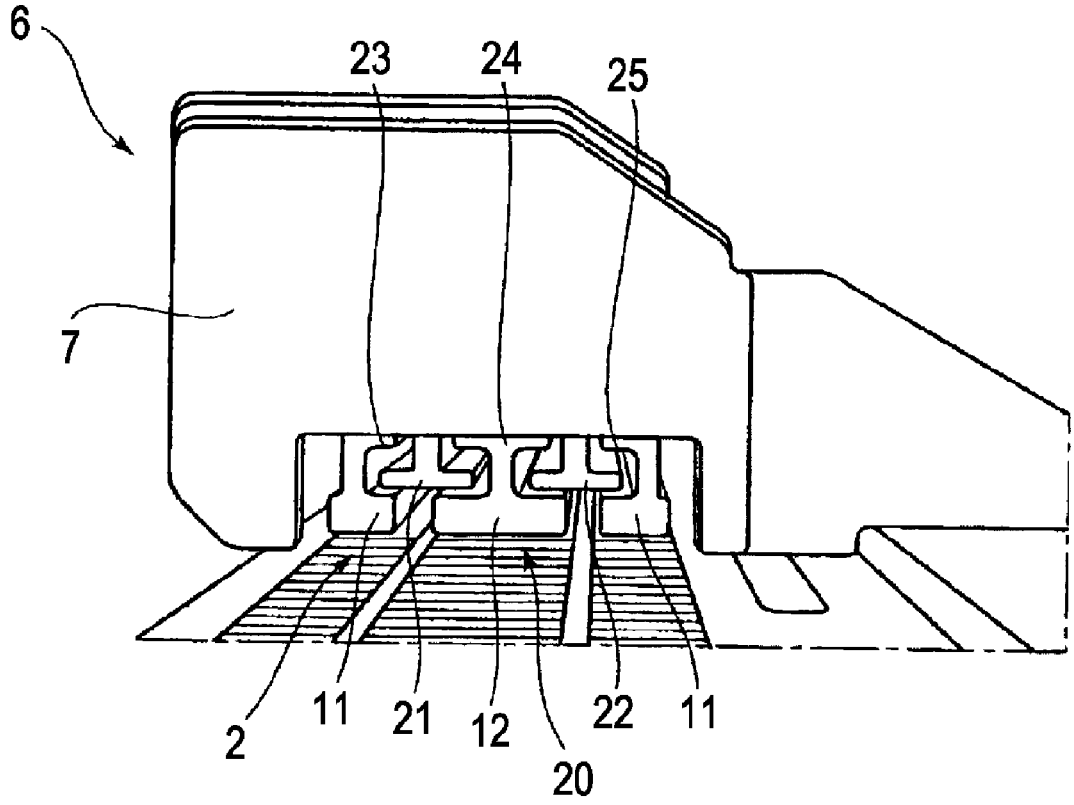
FIG. 6 is an enlarged perspective view corresponding to FIG. 4, as viewed from the opposite side.
Figure 7:
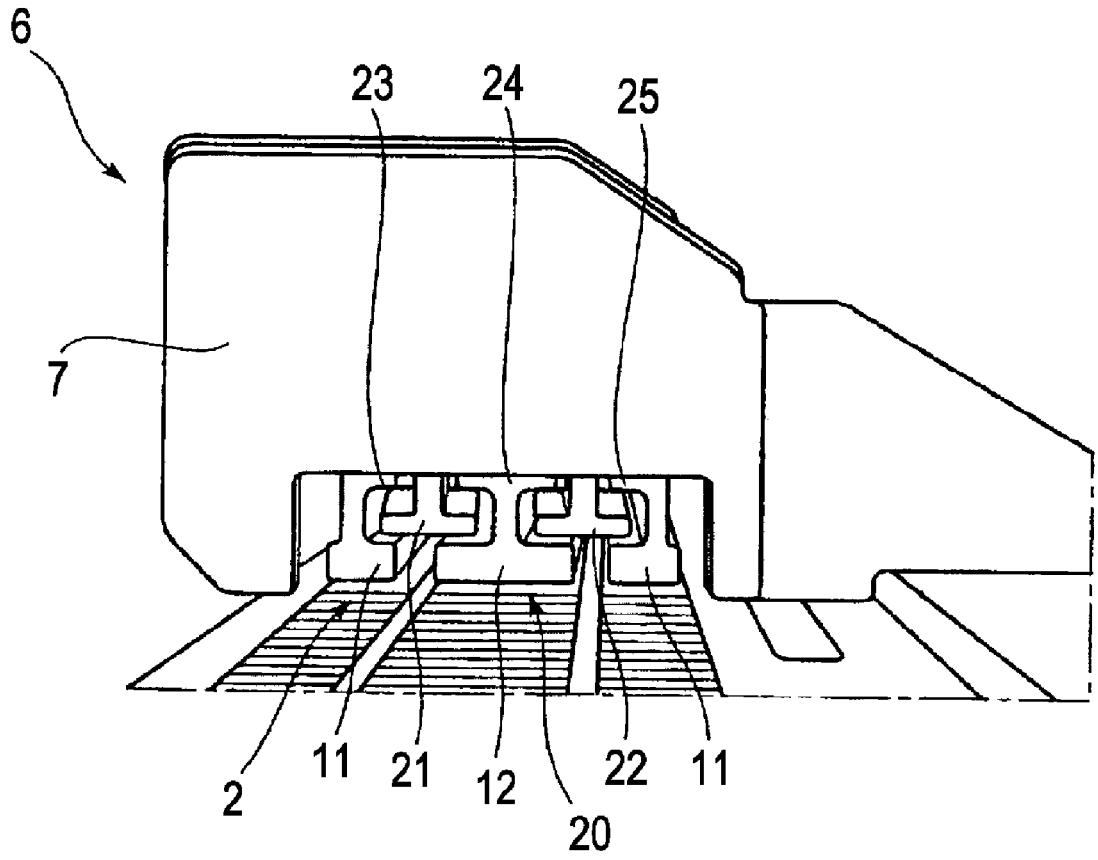
FIG. 7 is an enlarged perspective view corresponding to FIG. 5, as viewed from the opposite side.
Figure 8:
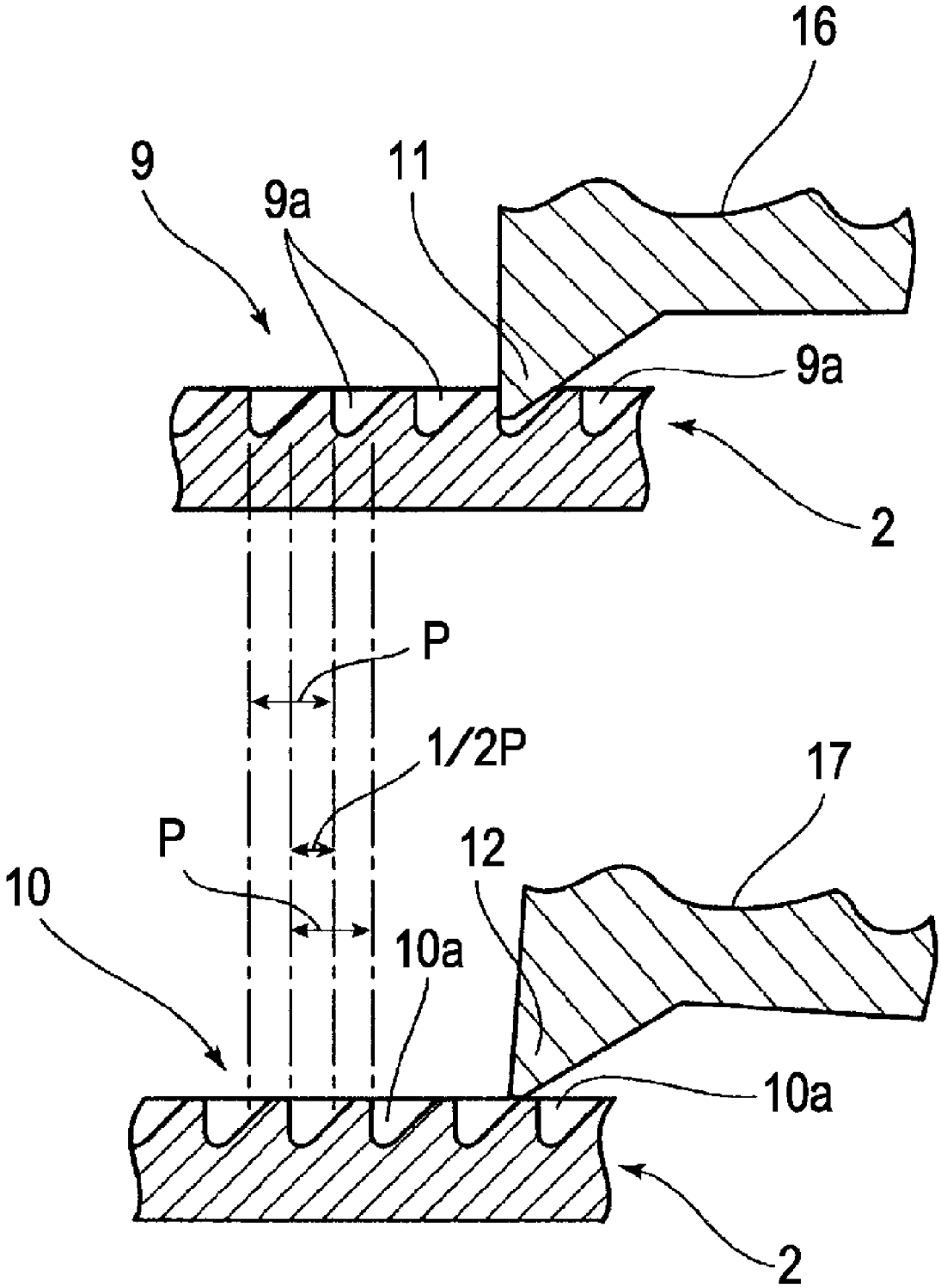
FIG. 8 is a cross-sectional view of a relevant part illustrating an engaged state between engaging protrusions and notches according to the present embodiment.

FIG. 1 is a perspective view, as viewed from the upper left side, showing one embodiment of a recording material feeding device that forms an ink jet recording apparatus, which is one example of a recording apparatus according to the invention. FIG. 2 is a perspective view of a relevant part of the device, with partially omitted, including an enlarged view of a relevant part, as viewed from the upper left side lower than the viewpoint of FIG. 1. FIG. 3 is a perspective view of a relevant part of the device, with partially omitted, as viewed from the upper right side. FIG. 4 is an enlarged perspective view of a movable edge guide which is in a fixed state according to the present embodiment. FIG. 5 is an enlarged perspective view of the movable edge guide which is released from the fixed state and in a slidable state. FIG. 6 is an enlarged perspective view corresponding to FIG. 4, as viewed from the opposite side. FIG. 7 is an enlarged perspective view corresponding to FIG. 5, as viewed from the opposite side. FIG. 8 is a cross-sectional view of a relevant part illustrating an engaged state between engaging protrusions and notches.

First Embodiment

A recording material feeding device according to the present embodiment includes a recording material mounting face portion 4 on which recording materials 1 are stacked for being fed, a body slide portion 5 that is attached to the recording material mounting face portion 4 so as to be slidable in the widthwise direction of the recording material 1, a movable edge guide 6 that includes a body operating portion 7 having a guide face 7*s* that contacts the side 1*s* of the recording material 1 to guide feeding, and a fixing means 2 (see FIG. 4 to FIG. 8) that fixes the position of a movable edge guide 6 in the slide direction.

The recording medium feeding device includes a feeding roller 31 that integrally rotates with a shaft 30, a member 32 that forms a feeding path of the recording material 1 with the feeding roller 31, the recording material mounting face portion 4, which is a hopper, that is swingable and that presses the stacked recording materials 1 against the feeding roller 31, and a frame 33 that pivotally supports the recording material mounting face portion 4. The recording material mounting face portion 4 is pivotally supported by a pair of support arm portions 34 positioned at both sides of the frame 33. The recording material mounting face portion 4 is supplied with power transmitted from a drive source (not shown) and swings between a hopper up and a hopper down to press the recording material 1 against the feeding roller 31. By rotating the feeding roller 31 in that pressed state, the recording material 1 will be fed. In this embodiment, a feeding path forming member 32 and the frame 33 (34) are separately manufactured and then assembled.

A record performing unit that performs recording on the recording material 1 that will be fed from the recording material feeding device is a known structure, so that it is not shown in the drawing.

In the recording material feeding device according to the present embodiment, the movable edge guide 6, by changing its position, may be compatible with sizes W of various large and small types, such as a known A4 or B5 size paper, postcard, and L-size paper.

In FIG. 1 to FIG. 3, the reference numeral 4*a* denotes a groove and the reference numeral 4*b* denotes a slit. These groove 4*a* and slit 4*b* are provided in the recording material mounting face portion 4. An engaging portion (not shown) is engaged with a portion corresponding to the movable edge guide 6 of which the upper end is suspended and supported at the upper side portion 4*c* of the recording material mounting face portion 4, so that a stable movement in the slide direction is ensured. In addition, in the present embodiment, the side walls 35, 36 (see FIG. 2) of both sides of the recording material mounting face portion 4 are integrally formed; the inner face of one side wall 35 in pairs with the movable edge guide 6 is configured as a fixed edge guide to regulate the position of the recording material 1.

The fixing means 2 includes notch columns 9, 10 that are provided on the surface of the recording material mounting face portion 4 along the slide direction of the movable edge guide 6 and engaging protrusions 11, 12 that are provided on the movable edge guide 6 and that engage notches 9*a*, 10*a* of the notch columns 9, 10 (see FIG. 8) to realize the fixed state. Then, the notch columns 9, 10 are formed of a plurality of columns (odd-numbered columns, three columns, in the present embodiment). The notch columns 9, 10 respectively includes the notches 9*a*, 10*a* formed at the same pitch P, and at least two columns among the notch columns 9, 10 are provided so that their phases are offset from each other.

The pitch P is set to a "minimum pitch" that is the limit of manufacturing technology.

Note that the invention is also applicable even when this pitch P is not set to the "minimum pitch" that is the limit of manufacturing technology.

In the present embodiment, the notch columns 9, 10 are formed of three columns in which the outside two notch columns 9 are formed to be in the same phase and the inside notch column 10 is provided to be in phase that is offset at a half pitch (P/2) from that of the outside notch columns 9.

Furthermore, as shown in the enlarged view of FIG. 2, the width of the inside notch column 10 is 2L, and the width of the outside notch columns 9 is L. The width of the inside notch column 10 is formed twice the width as the outside notch columns 9.

The engaging protrusions 11, 12 independently provided for the respective notch columns 9, 10.

That is, as shown in FIG. 6 to FIG. 8, the engaging protrusions 11, 12 of the movable edge guide 6 are provided respectively at the free end sides of separated elastic pieces 16, 17, 18 that are separated in such a manner that parallel slits 15*a*, 15*b*, 15*c*, 15*d* are provided in a plate-like portion 55 of the body slide portion 5. The engaging positions of the engaging protrusions 11, 12 are side by side at the same positions in the slide direction.

Furthermore, the movable edge guide 6 is provided with an engaging/disengaging means 20 that switches between an "engaged state", in which the engaging protrusion(s) 11 or 12 is/are engaged with the notch(es) 9*a* or 10*a*, and a "disengaged state", in which the engaging protrusions 11, 12 are disengaged from the notches 9*a*, 10*a* by applying force that bends the separated elastic pieces 16, 17, 18. The separated elastic pieces 16, 17, 18 are configured to have the same thickness.

The engaging/disengaging means 20 includes a swing knob 8 that is provided on the body operating portion 7, inverted T-shaped hook portions 21, 22 that are provided on the swing knob 8, and hooked portions 23, 24, 25 that are provided on the separated elastic pieces 16, 17, 18 and engaged with the hook portions 21, 22. Then, as shown in FIG. 4 to FIG. 7, when the swing knob 8 is swung, the hook portions 21, 22 are configured to engage the hooked portions 23, 24, 25 and then apply force that bends the separated elastic pieces 16, 17, 18 so as to realize the disengaged state.

Next, the operation of the recording material feeding device will be described.

A plurality of the notch columns 9, 10 are formed. Each of the notch columns 9, 10 is formed so that the notches 9*a*, 10*a* have the same pitch P, and at least two columns of the notch columns 9, 10 are provided offset in phase. Thus, even when the notch columns 9, 10 are formed with a "minimum pitch" of manufacturing limit, the pitch between the notch columns 9, 10 that are offset in phase from each other becomes further smaller than the "minimum pitch" by that phase offset amount, so that the plurality of notch columns 9, 10 as a whole have notch columns with a further high resolution that exceeds the "minimum pitch" of manufacturing limit.

Figure 9:
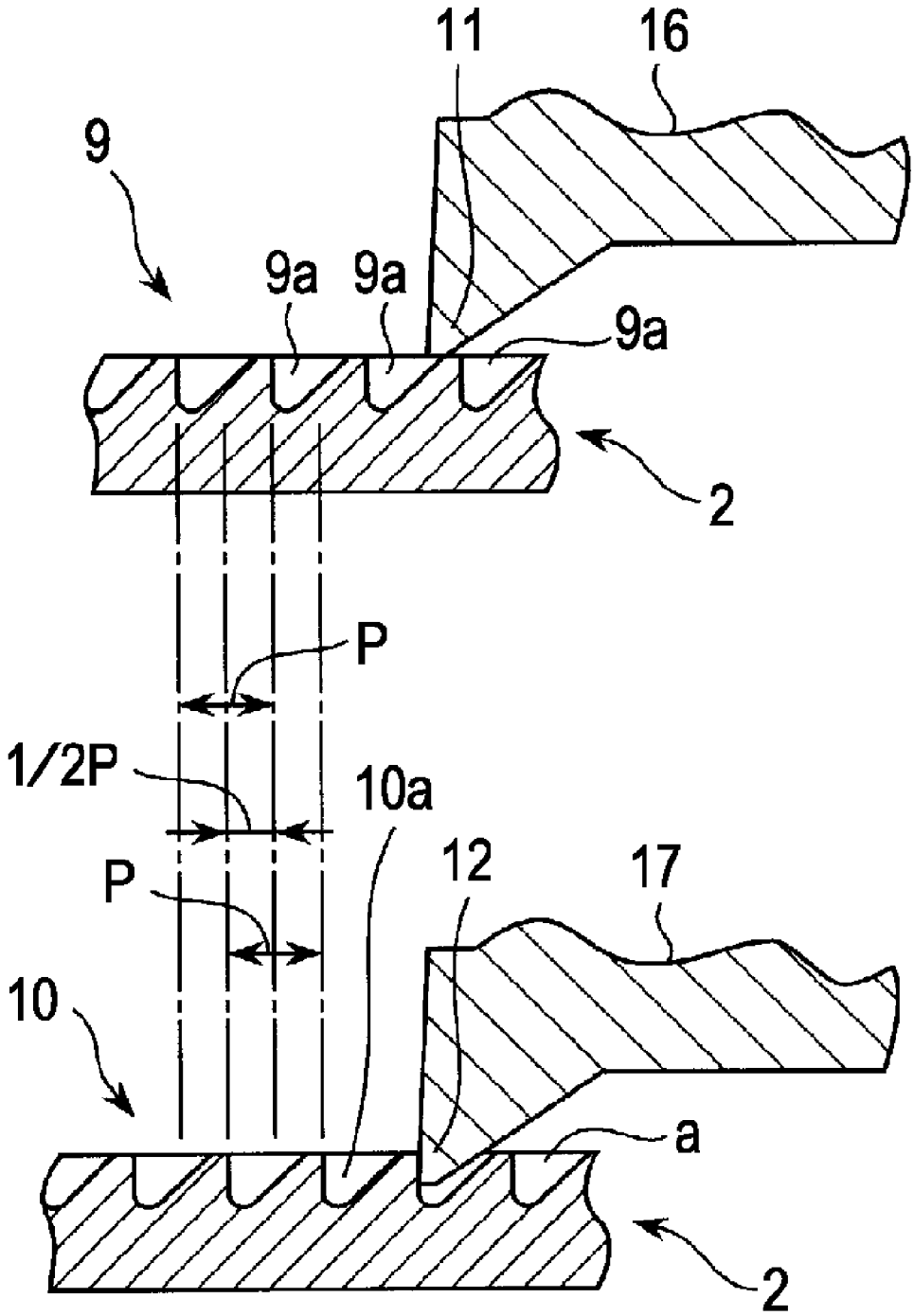
FIG. 9 is a cross-sectional view of a relevant part illustrating another engaged state between the engaging protrusions and the notches according to the present embodiment.

Then, the engaging protrusions 11, 12 are provided independently for the respective notch columns 9, 10. Thus, a fixed position in which, as shown in FIG. 8, one engaging protrusions 11 firmly engage the notches 9*a* of the opposed notch columns 9 while the other engaging protrusion 12 cannot be engaged with the notch 10*a* of the opposed notch column 10 and a fixed position in which, as shown in FIG. 9, one engaging protrusions 11 cannot be engaged with the notches 9*a* of the opposed notch columns 9 while the other engaging protrusion 12 is able to firmly engage the notch 10*a* of the opposed notch column 10 are performed by the unit of the offset in phase.

As described above, according to the present embodiment, it is possible to realize a notch column with a high resolution that exceeds the limit of manufacturing technology of the notch columns 9, 10, and, thereby, it is possible to realize further improvement of recording quality.

Furthermore, in the present embodiment, the notch columns 9, 10 are formed of three columns in which the outside two notch columns 9 are formed to be in the same phase and the inside notch column 10 is provided to be in phase that is offset at a half pitch (½ pitch) from that of the outside notch columns 9. Thus, it is possible to obtain the above operation and advantageous effects with a simple structure.

Furthermore, in the present embodiment, because the inside notch column 10 is twice the width as the outside notch columns 9, by forming the width of the engaging protrusion on the basis of the same relationship as "twice" in the notch columns (the inside engaging protrusion is twice the width as the outside one), even when any engaged state between an engaged state in which the outside notch columns are engaged and an engaged state in which the inside notch column is engaged, the length of contact between the engaging protrusion and the notch may be made equal, so that the fixing force (engaging force) also becomes substantially equal, and, hence, it is possible to ensure reliability and stability of edge guide operation.

Moreover, in the present embodiment, the engaging protrusions 11, 12 of the movable edge guide are respectively provided at the free end sides of the separated elastic pieces 16, 17, 18 that are separated by providing the plate-like portion 55 of the body slide portion 5 with the parallel slits 15*a*, 15*b*, 15*c*, 15*d*. Further, the movable edge guide 6 is provided with the engaging/disengaging means 20 that switches between an "engaged state", in which the engaging protrusion (s) 11, 12 is/are engaged with the notch(es) 9*a* or 10*a*, and a "disengaged state", in which the engaging protrusions 11, 12 are disengaged from the notches 9*a*, 10*a* by applying force that bends the separated elastic pieces 16, 17, 18.

Then, the engaging/disengaging means 20 includes the swing knob 8 that is provided on the body operating portion 7, the hook portions 21, 22 that are provided on the swing knob 8, and the hooked portions 23, 24, 26 that are provided on the separated elastic pieces 16, 17, 18 and engaged with the hook portions 21, 22. When the swing knob 8 is swung, the hook portions 21, 22 are configured to engage the hooked portions 23, 24, 25 and apply force that bends the separated elastic pieces 16, 17, 18 to realize the disengaged state.

Thus, the separated elastic pieces 16, 17, 18 are formed by the slits 15*a*, 15*b*, 15*c*, 15*d* and the separated elastic pieces 16, 17, 18 are bent by the engaging/disengaging means 20 to switch between the "engaged state" and the "disengaged state", so that it is possible to perform manipulation of sliding the movable edge guide 6 and fixing the position of the movable edge guide 6 for adjusting to the width of the recording material 1 with high operability. Moreover, when the swing knob 8 is swung, the hook portions 21, 22 are configured to engage the hooked portions 23, 24, 25 and apply force that bends the separated elastic pieces 16, 17, 18 to realize the disengaged state, so that it is possible to simply perform switching between engaging and disengaging with a simple structure.

Second Embodiment

In the above embodiment, the notch columns 9 and the notch column 10 both are provided over the entire length of a moving area in which the movable edge guide 6 is moved, and the phase offset portion is provided over the entire length of the moving area. However, the phase offset portion of the notch columns 9, 10 may be formed so that the notch column formed over the entire length of the moving area of the movable edge guide, for example, one notch columns 9 are defined as base columns and the other notch column 10 is provided along part of the area of the base columns. According to the thus configured second embodiment, it is possible to increase the resolution of only part of the area that is frequently used and, hence, it becomes a simple structure.

Third Embodiment

Figure 10:
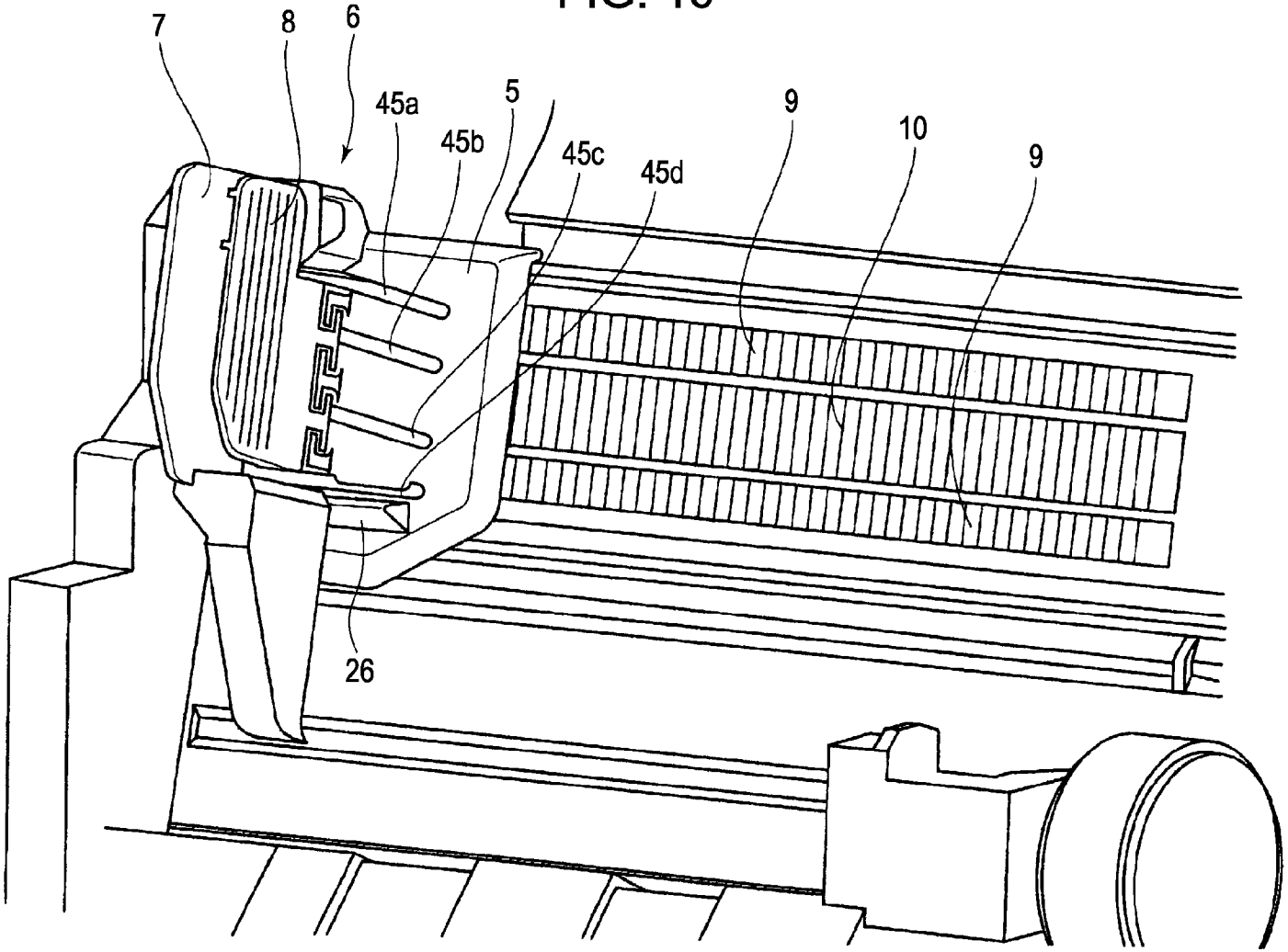
FIG. 10 is a perspective view of a recording material feeding device according to a fifth embodiment.
Figure 11:
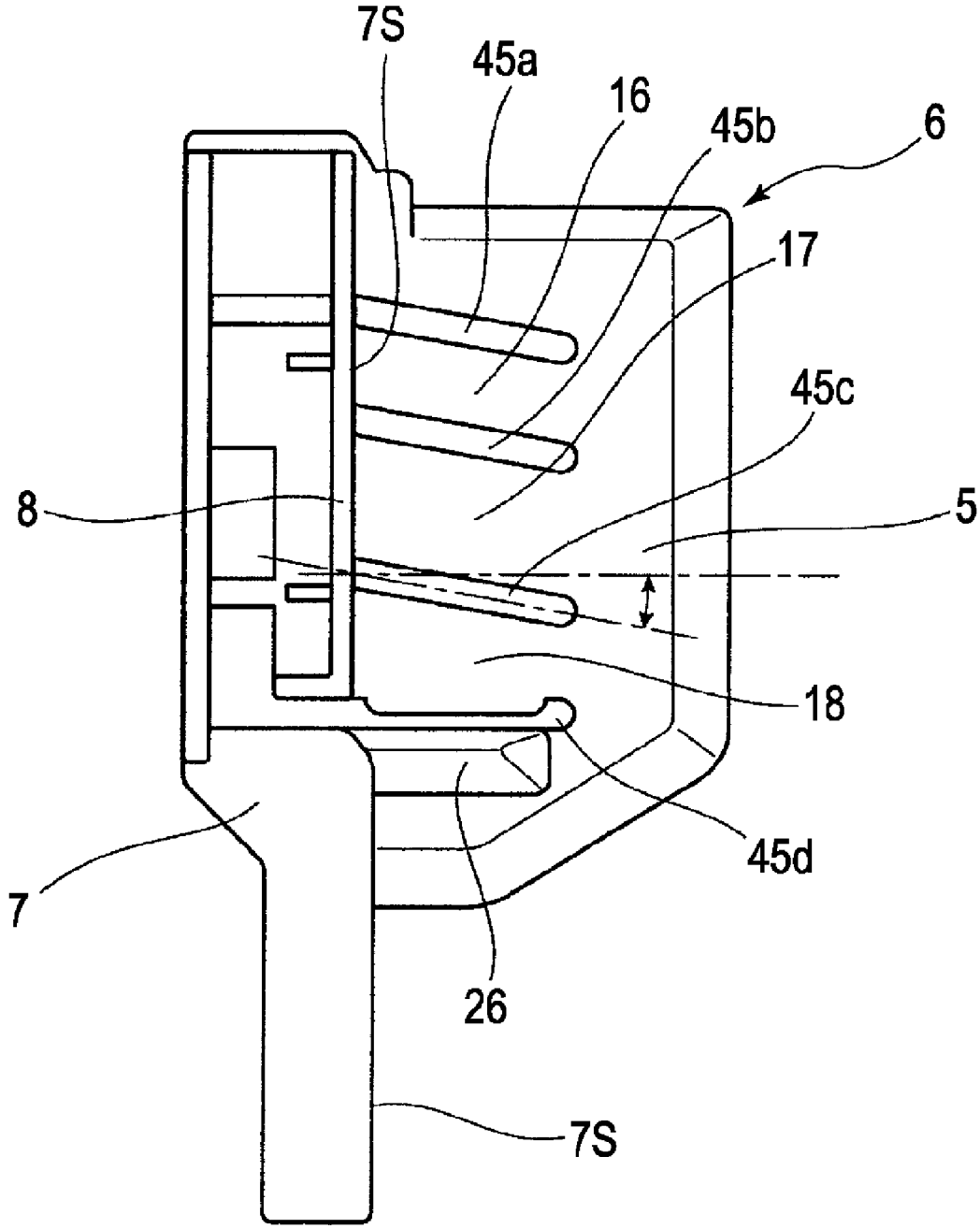
FIG. 11 is a plan view of a movable edge guide that is used in the device.
Figure 12:
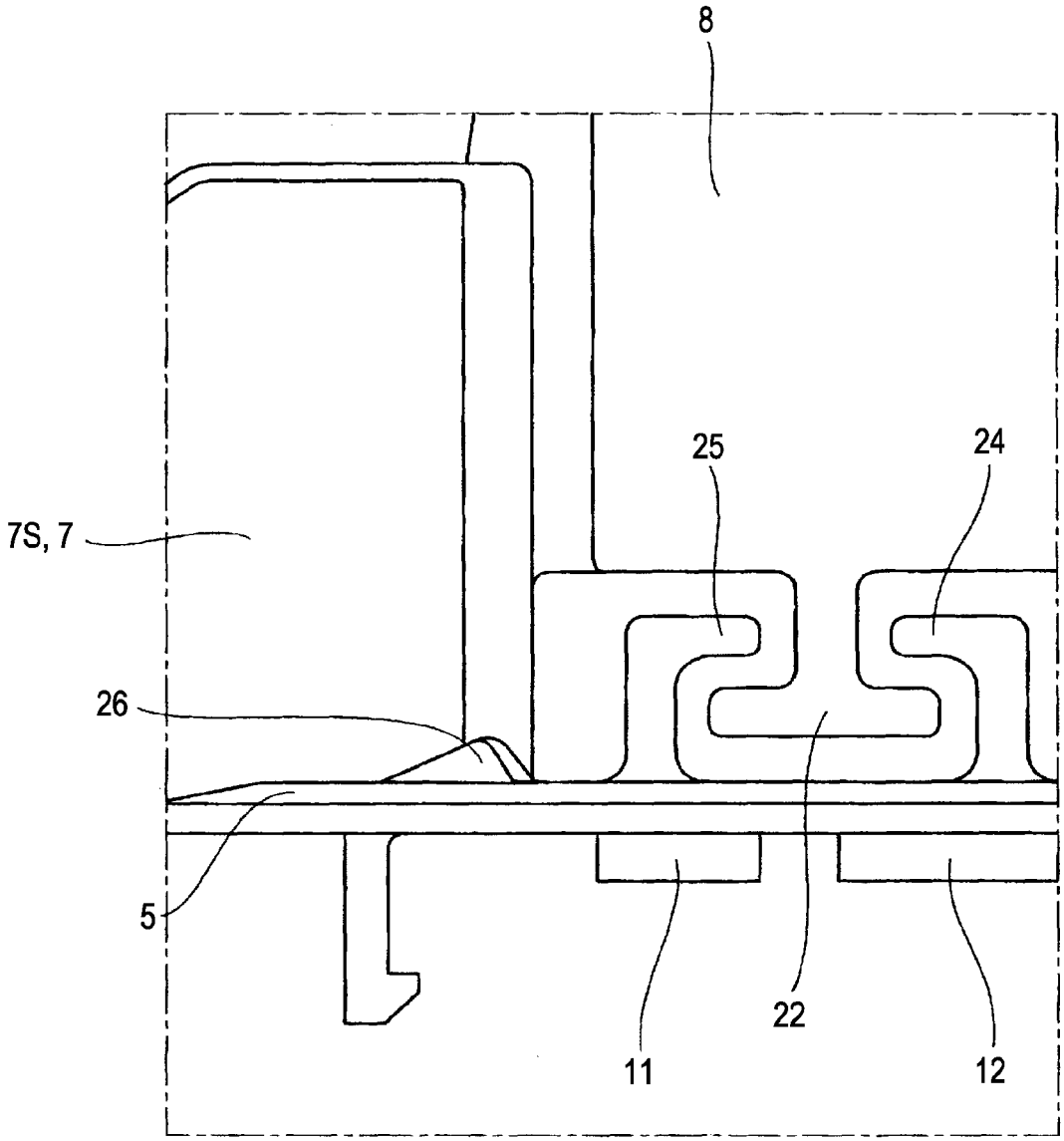
FIG. 12 is an enlarged perspective view of a relevant part of the movable edge guide.

A third embodiment that differs from the above embodiments will be described. FIG. 10 is a perspective view of a recording material feeding device according to the third embodiment. FIG. 11 is a plan view of a movable edge guide that is used in the device. FIG. 12 is an enlarged perspective view of a relevant part of the movable edge guide.

The outer surface of the plate-like portion of the body slide portion 5 is configured to function as a recording material mounting surface on which the recording materials 1 are mounted. This point is the same as those of the first and second embodiments.

In the third embodiment, in addition to the above structure, a guide salient portion 26 that guides an end side portion 1*e* (see FIG. 2), which is a distal end in an advancing direction when the recording material 1 advances in the reverse direction at the time when the recording material 1 is returned in the reverse direction of the transport direction, in a direction away from the outer surface of the plate-like portion is provided at the downstream side of the slit 45*d* that is located at the most downstream side among the slits 45*a*, 45*b*, 45*c*, 45*d* of the body slide portion 5.

Furthermore, in the third embodiment, the slits are provided so as to be inclined relative to the slide direction. That is, slits 46*a*, 45*b*, 45*c* are provided so as to be inclined. Note that the invention also encompasses the structure in which the slits are not inclined and, therefore, the guide salient portion 26 may be provided relative to the slits 15*a*, 15*b*, 15*c*, 15*d* that are parallel to the slide direction as in the case of the first embodiment.

The recording material 1 may possibly be returned in the reverse direction of the transport direction in transport control. When the recording material 1 is returned in the reverse direction after the end side portion 1*e* of the recording material 1 is fed up to the downstream side beyond the position of the movable edge guide 6, and if the recording material 1 is the last one sheet, the rear face of the end side portion 1*e* of the recording material 1 is moved while directly rubbing the recording material mounting face. Thus, there is a possibility that the corner portion of the end side portion 1*e* is caught by the slits 15*a*, 15*b*, 15*c*, 15*d*.

According to the third embodiment, because a guide salient portion 26 that guides an end side portion 1*e*, which is a distal end in an advancing direction when the recording material 1 advances in the reverse direction at the time when the recording material 1 is returned in the reverse direction of the transport direction, in a direction away from the outer surface of the plate-like portion is provided, the corner portion of the end side portion 1*e* of the recording material 1 is guided in a direction away from the slits 15*a*, 15*b*, 15*c*, 15*d*. Thus, it is possible to reduce the possibility that the corner portion is caught by the slits 15*a*, 15*b*, 15*c*, 15*d*.

Moreover, in the third embodiment, as described above, the slits are provided so as to be inclined relative to the slide direction. That is, in addition to the guide salient portion 26, the slits 45*a*, 45*b*, 45*c* are further provided so as to be inclined.

According to the above inclined slit structure, even if the corner portion of the end side portion 1*e* of the recording material 1 contacts the slits 45*a*, 45*b*, 45*c* when the recording material 1 is returned in the reverse direction of the transport direction, because the slits 45*a*, 45*b*, 45*c* are provided so as to be inclined relative to the slide direction as described above, the inclination releases force by which the recording material 1 is caught. Thus, a troublesome due to the catch hardly occurs. That is, even when the recording material 1 is guided by the guide salient portion 26 in the direction away from the slits 45*a*, 45*b*, 45*c*, there is a possibility that the end side portion 1*e*, due to the partial deformation of the recording material 1, contacts the slits 45*a*, 45*b*, 45*c*. However, according to the present embodiment, owing to the inclined slit structure, a troublesome due to the catch hardly occurs as described above.

Furthermore, the slits 45*a*, 45*b*, 45*c* are inclined in such an orientation that the free end sides of the separated elastic pieces 16, 17, 18 (the side on which the engaging protrusions 11, 12 are provided) are positioned upstream in the transport direction of the recording material 1 beyond the proximal end sides of the separated elastic pieces 16, 17, 18. In this manner, even if the corner portion of the end side portion 1*e* of the recording material 1 contacts the slits 45*a*, 45*b*, 45*c*, the above oriented inclination stably releases force by which the recording material 1 is caught. Thus, a troublesome due to the catch hardly occurs.

In the third embodiment, the structure in which the slits 45*a*, 45*b*, 45*c* are provided in addition to the guide salient portion 26 is described; however, the slits 45*a*, 45*b*, 45*c*, 45*d* may be inclined without providing the guide salient portion 26 (not shown). According to the inclined structure, without the guide salient portion 26, it is also possible to reduce the possibility of troublesome due to the catch.

Fourth Embodiment

Figure 13:
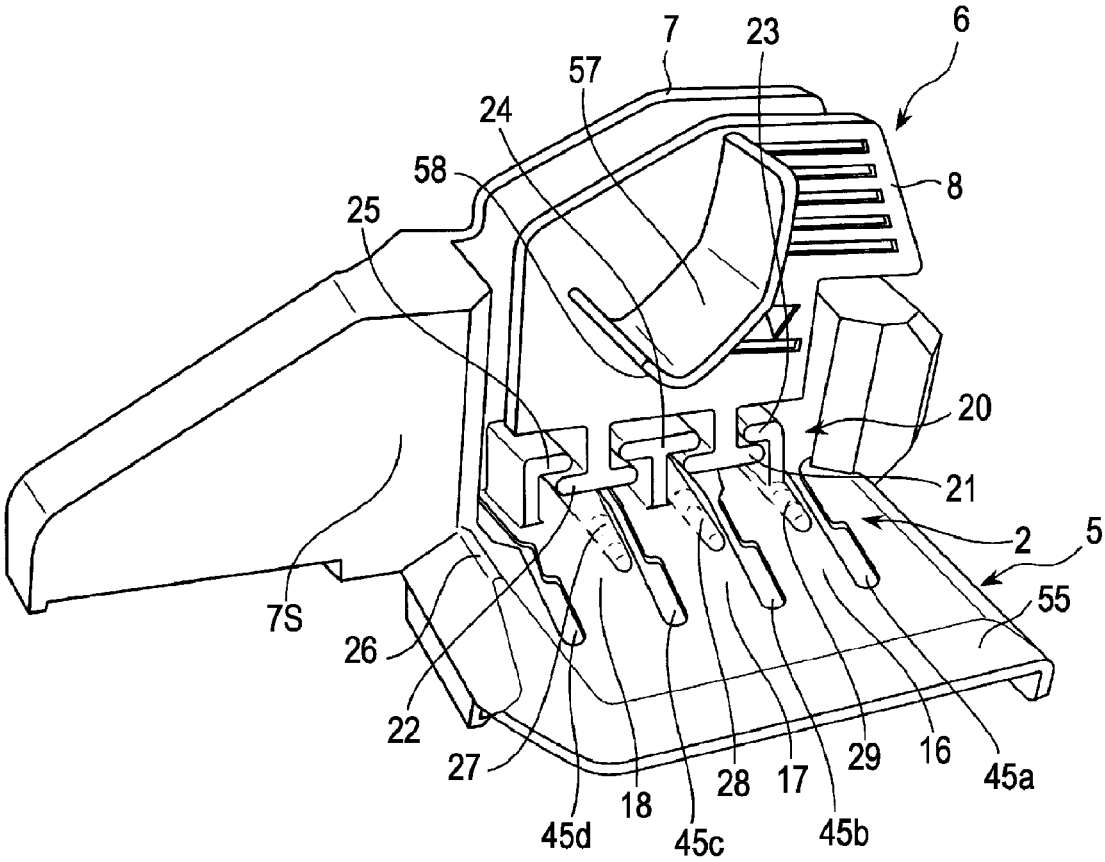
FIG. 13 is a perspective view of a movable edge guide, as viewed from the obliquely downward side, used for a recording material feeding device according to a fourth embodiment.
Figure 14:
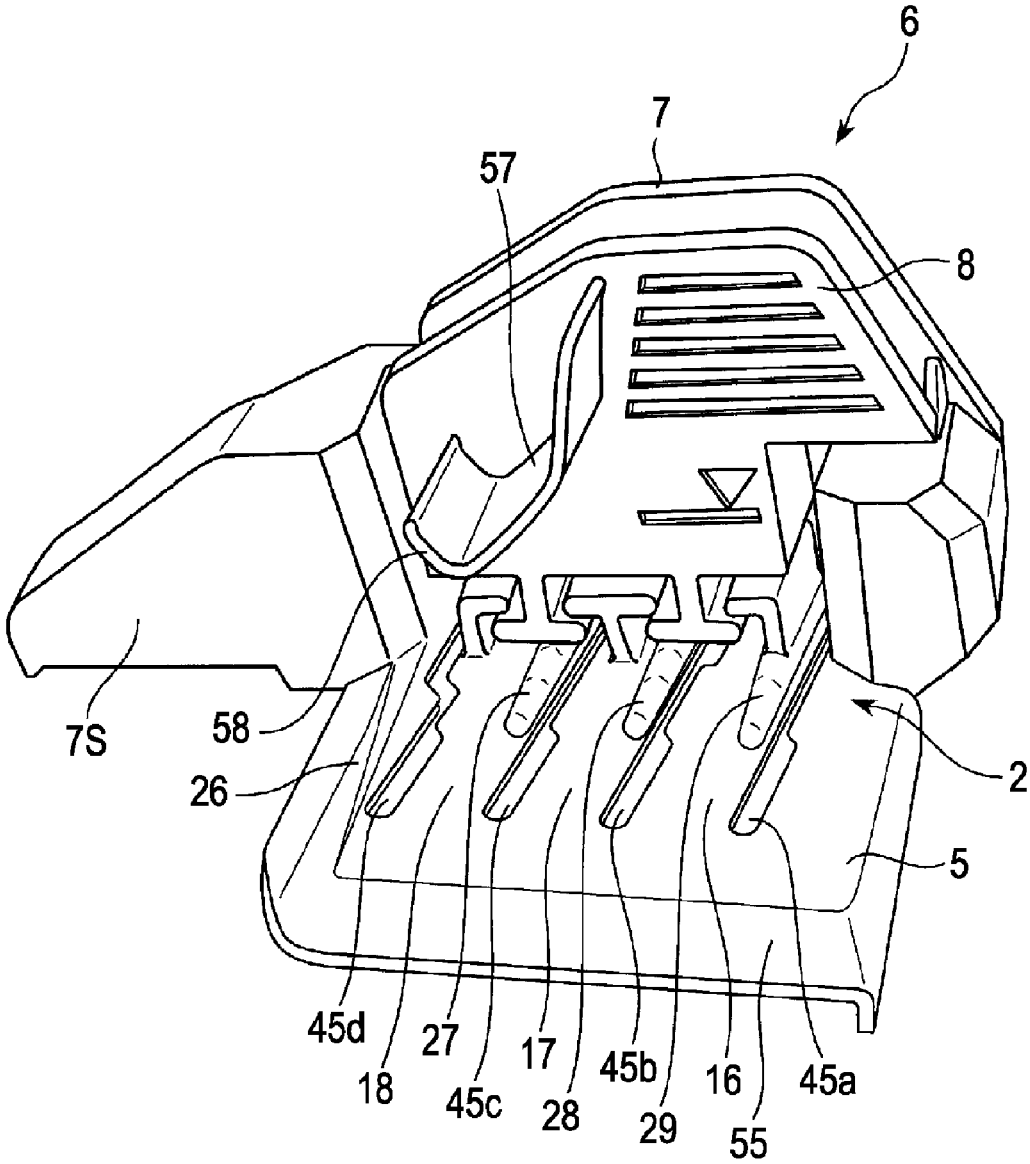
FIG. 14 is a perspective view of the movable edge guide, as viewed from the obliquely upward side, according to the fourth embodiment.
Figure 15:
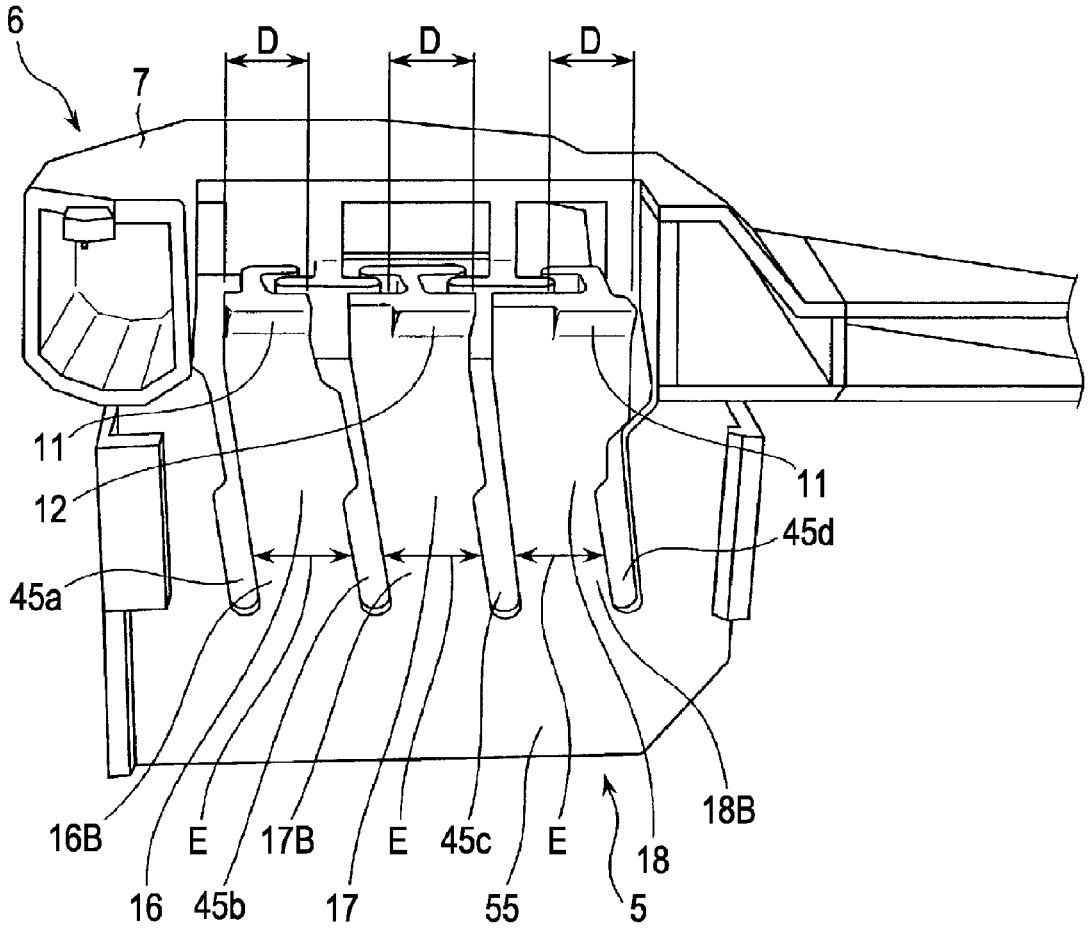
FIG. 15 is a perspective view of the rear side of the movable edge guide according to the fourth embodiment.
Figure 16:
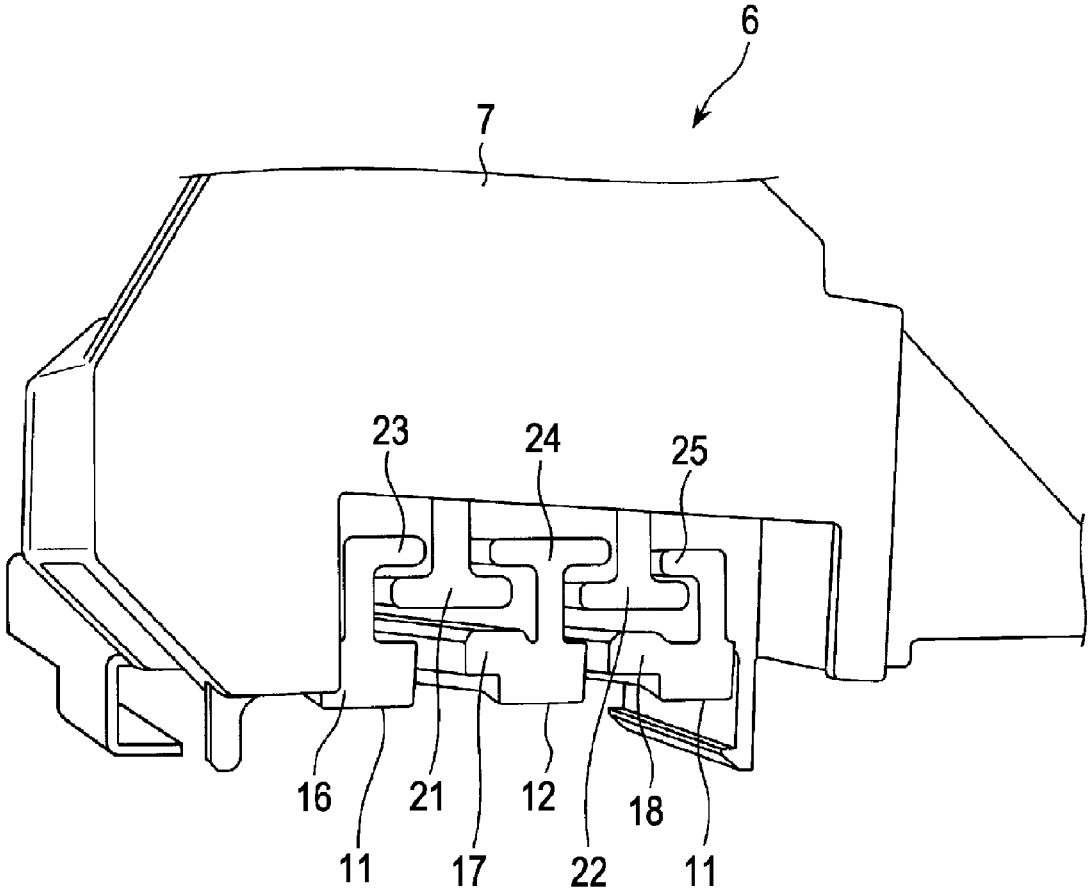
FIG. 16 is a perspective view of the movable edge guide, as viewed from the opposite side of FIG. 13, according to the fourth embodiment.

A fourth embodiment that differs from the above embodiments will be described. FIG. 13 is a perspective view of a movable edge guide, as viewed from the obliquely downward side, used for a recording material feeding device according to the fourth embodiment. FIG. 14 is a perspective view of the movable edge guide, as viewed from the obliquely upward side. FIG. 15 is a perspective view of the rear side of the movable edge guide. FIG. 16 is a perspective view of the movable edge guide, as viewed from the opposite side of FIG. 13.

In the recording material feeding device according to the fourth embodiment, the separated elastic pieces 16, 17, 18 are set to apply the same urging force that presses the engaging protrusions 11, 12 against the notches 9*a*, 10*a*. Further, the engaging protrusions 11, 12, as shown in FIG. 15, are configured to have the same width D of the engaging protrusions. In the present embodiment, the proximal portions 16B, 17B, 18B of the separated elastic pieces 16, 17, 18 are configured to have the same width E, and the separated elastic pieces 16, 17, 18 are configured to have the same thickness, so that it realizes to set the urging forces using the separated elastic pieces 16, 17, 18. In addition, the slits 45*a*, 45*b*, 45*c*, 45*d* that are provided for forming the separated elastic pieces 16, 17, 18 are all provided so as to be inclined relative to the slide direction.

In the present embodiment, the distal end side portions of the separated elastic pieces 16, 17, 18 than the proximal portions 16B, 17B, 18B are configured to be further wider than the width E. In this manner, as shown in FIG. 15, the arrangement positions of the engaging protrusions 11, 12 may be set within the range of the wide portions, so that degree of freedom for setting the arrangement, when the engaging protrusions 11, 12 are appropriately arranged in correspondence with the positions of the notch columns 9, 10, is increased.

In the third embodiment, one guide salient portion 26 is provided only on the downstream side of the slit 45*d* that is located at the most downstream side. However, in the fourth embodiment, as shown in FIG. 13 and FIG. 14, other guide salient portions 27, 28, 29 are further provided on the downstream sides of the other slits 45*a*, 45*b*, 45*c* as well.

Note that, in FIG. 13 and FIG. 14, the reference numeral 57 denotes a recording material regulating piece. The recording material regulating piece 57 is used for limiting the number of set recording materials to a predetermined amount or below. The recording material regulating piece 57 is curvedly formed so that a portion in proximity to the recording material 1 extends in a direction away from the recording material in order not to leave a mark on the surface of the recording material 1 when the recording material mounting face portion 4, which is a hopper, is switched from an up position to a down position.

According to the fourth embodiment, the engaging protrusions 11, 12 of the movable edge guide 6 are set to apply the same urging force that presses the engaging protrusions 11, 12 against the notches 9*a*, 10*a*, and the engaging protrusions 11, 12 all have the same width D, so that the engaging characteristics relative to the opposed notch columns 9, 10 are the same between the outside engaging protrusions 11 and the inside engaging protrusion 12. Thus, it is possible to reduce the possibility that the engaging characteristics relative to the notch columns 9, 10 between the outside engaging protrusions 11 and the inside engaging protrusion 12 tends to be unbalanced and to make it uniform, and, hence, it is possible to improve operability.

In addition, because the other guide salient portions 27, 28, 29 are provided on the downstream side of the other slits 45*a*, 45*b*, 45*c* as well, the corner portion of the end side portion 1*e* of the recording material 1 is guided in a direction away from each of the slits 45*a*, 45*b*, 45*c*, 45*d*, so that it is possible to further reduce the possibility that the corner portion is caught by the slits 45*a*, 45*b*, 45*c*, 45*d*.

Fifth Embodiment

Figure 17:
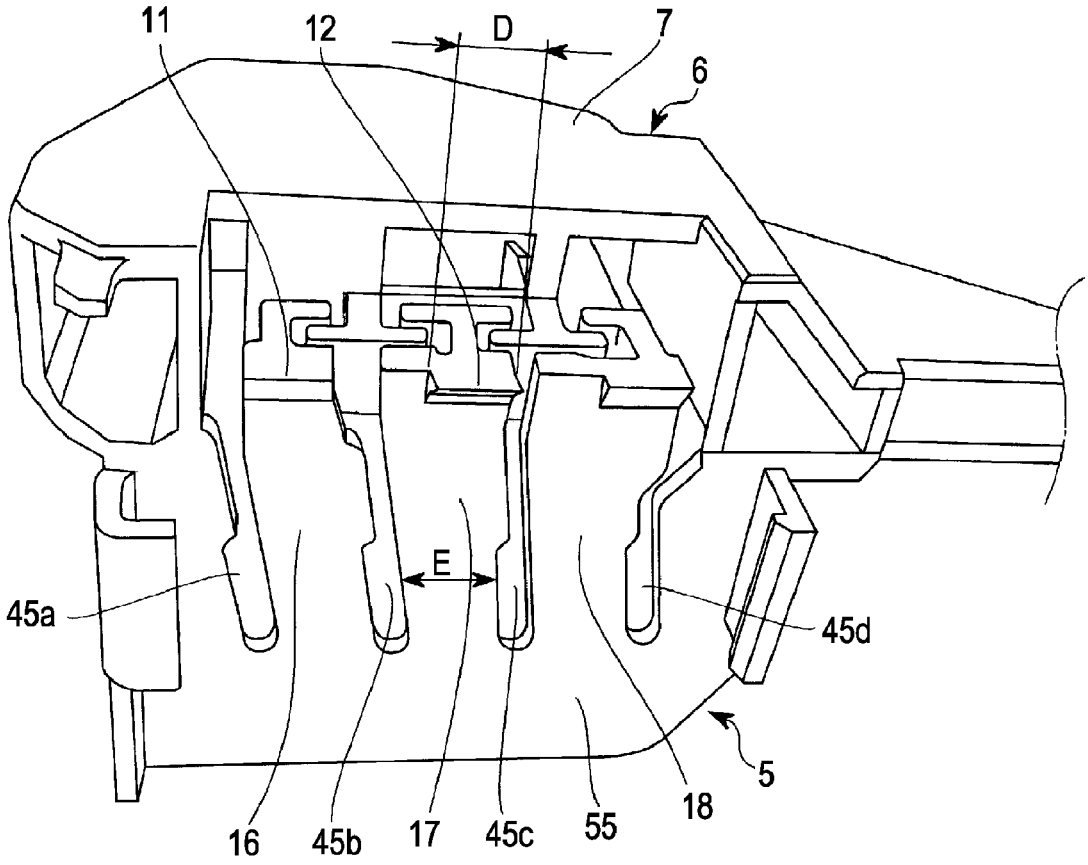
FIG. 17 is a perspective view of a relevant part of the movable edge guide according to a fifth embodiment.
Figure 18:
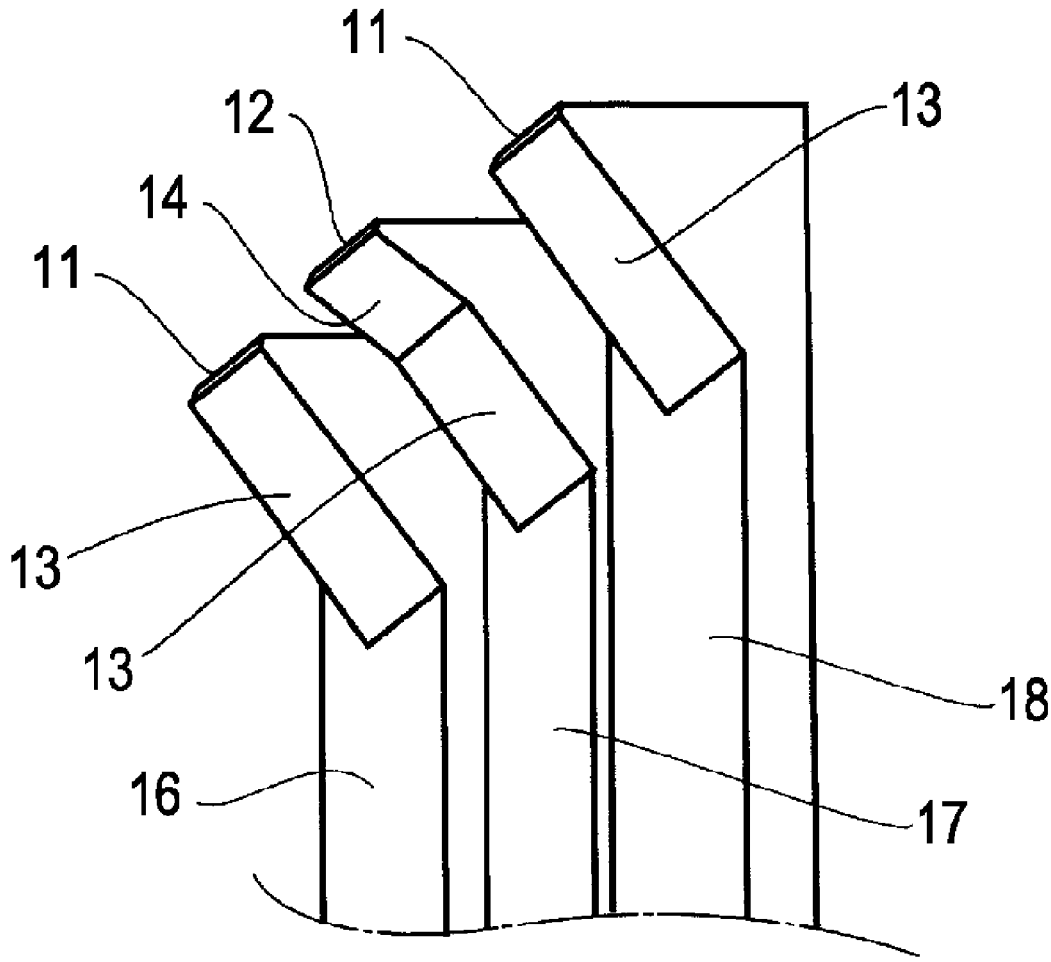
FIG. 18 is an enlarged perspective view of engaging protrusions of the movable edge guide.
Figure 19:
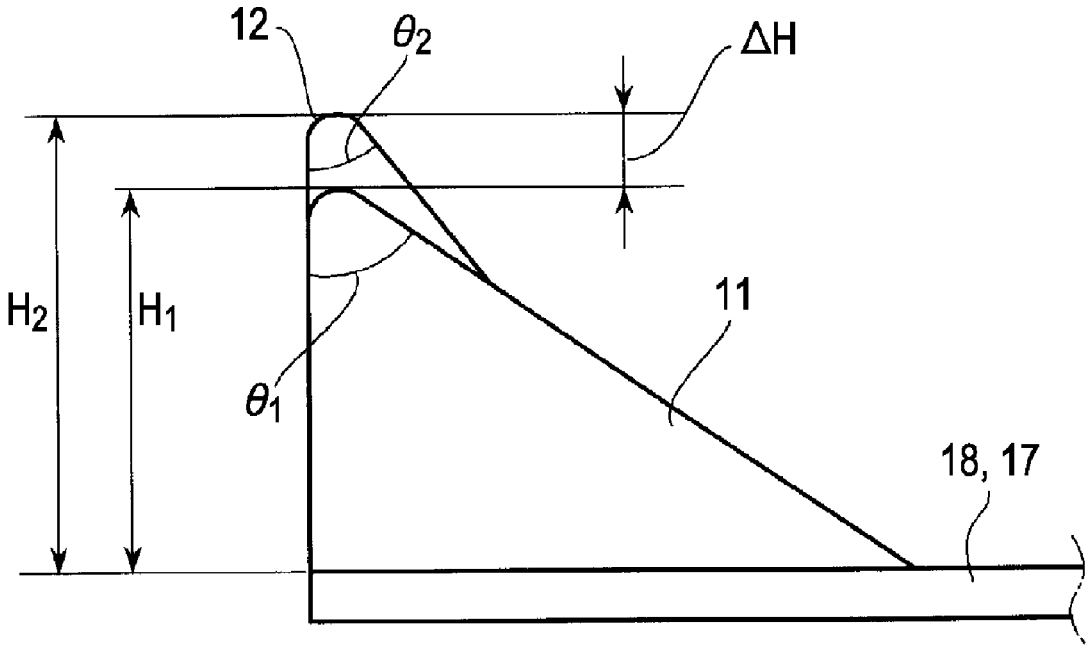
FIG. 19 is an explanatory view illustrating the projecting sizes of the engaging protrusions.

A fifth embodiment for which the fourth embodiment is improved will be described. FIG. 17 is a perspective view of a relevant part of the movable edge guide that is used for a recording material feeding device according to the fifth embodiment. FIG. 18 is an enlarged perspective view of a portion of engaging protrusions of the movable edge guide. FIG. 19 is an explanatory view illustrating the projecting sizes of the engaging protrusions.

In the recording material feeding device according to the fifth embodiment, the engaging protrusions 11, 12 of the movable edge guide 6 are formed so that the engaging protrusion 12 that engages the notch 9*a*, 10*a* in smaller number is formed longer in projecting size than the engaging protrusions 11 that engage the notches 9*a*, 10*a* in larger number. Specifically, the center engaging protrusion 12 that faces the center notch column 10 located at the center among the odd-numbered (in this embodiment, three columns) notch columns 9, 10, 9 is formed longer in projecting size than the other engaging protrusions 11. Note that the notch columns are not limited to be odd numbered, but the even-numbered columns may also be embraced in the present embodiment. In addition, needless to say, the engaging protrusion that engages the notch in smaller number is not limited to the one that is located at the center among the plurality of engaging protrusions.

The difference ΔH between the projecting sizes is, as shown in FIG. 19, a difference between the projecting size H1 of the engaging protrusions 11 and the projecting size H2 of the center engaging protrusion 12. Furthermore, the distal end angle θ2 of the center engaging protrusion 12 is formed more acutely than the distal end angles θ1 of the engaging protrusions 11.

The operation of the fifth embodiment will now be described.

As described in the fourth embodiment, the urging forces that press the engaging protrusions 11, 12 against the notches are set equal and the engaging protrusions are formed to have the same width. In this configuration, the magnitude of reaction force based on forcibly bent deformation of the separated elastic pieces 16, 17, 18 differs between a small-number engaged state (that is, a large-number non-engaged state) in which the engaging protrusion 12 engages the notch 10*a* in small number and a large-number engaged state (that is, a small-number non-engaged state) in which the engaging protrusions 11 engage the notches 9*a* in large number. The small-number engaged state, that is, the large-number non-engaged state, generates larger reaction force. Therefore, in the engaging protrusion 12 located at the engaged position in that state, the engaging force of the engaging protrusion 12 with the notch 10*a* becomes unstable due to the action of the large reaction force and, hence, there is a possibility that the engaging protrusion 12 comes off from the notch 10*a*.

However, according to the present embodiment, the above engaging protrusions 11, 12 are formed so that the engaging protrusion 12 that engages the notch 10*a* in the small-number engaged state is formed longer in projecting size than the other engaging protrusions 11 that engage the notches 9*a* in the large-number engaged state. Thus, by absorbing the influence of the reaction force with the difference between the projecting sizes, it is possible to reduce the possibility that the engaging force of the engaging protrusion 12 with the notch 10*a* becomes unstable and, thereby, it is possible to reliably make the engaging protrusion be engaged with the notch.

Sixth Embodiment

In the fourth and fifth embodiments, the engaging protrusions 11, 12 of the movable edge guide 6 are set to apply the same urging force that presses the notches 9*a*, 10*a*, and the engaging protrusions 11, 12 have the same width D. However, in the present sixth embodiment, the urging force and the width D are not limited to those.

The recording material feeding device according to the sixth embodiment has such a feature that the separated elastic pieces 16, 17, 18 are set to apply such elastic forces of the separated elastic pieces 16, 17, 18 that the amount of engagement by which the engaging protrusion is engaged with the notch becomes equal between both position fixed states, that is, one position fixed state in which a portion of the engaging protrusion(s) engage(s) the notch(es) and the other engaging protrusion(s) cannot engage the notch(es) and the other position fixed state in which a portion of the engaging protrusion (s) cannot engage the notch(es) and the other engaging protrusion(s) engage(s) the notch(es).

The separated elastic pieces 16, 17, 18 having the engaging protrusions, which are located at the positions that cannot engage the notches, at their distal ends are forcibly bent in the reverse direction against the urging forces of the separated elastic pieces 16, 17, 18, so that the reaction force is generated on the basis of the forcibly bent deformation. Because the reaction force acts in a direction in which the bent deformation is reduced, the reaction force is applied in a direction in which the other engaging protrusion(s) that is/are engaged with the notch(es) is/are disengaged from the engaged position(s). Depending on the relationship in magnitude between the force that acts in the disengaging direction and the urging force, there is a possibility that the engaging force of the engaging protrusion with the notch becomes unstable and the engaging protrusion then comes off from the notch.

However, according to the sixth embodiment, the elastic forces of the separated elastic pieces 16, 17, 18 are set so that the amount of engagement by which the engaging protrusion engages the notch becomes equal in both position fixed states. The structure (width, thickness, and the like) of portions that generate the elastic forces of the separated elastic pieces 16, 17, 18 is set so that the reaction forces become equal in both position fixed states. In this manner, it is possible to reduce the possibility that the engaging force of the engaging protrusion with the notch, when the engaging protrusion is located at the engaged position, becomes unstable due to the reaction force and, thereby, it is possible to reliably make the engaging protrusion be engaged with the notch.

In the above described embodiments, the engaging protrusions in combination in which the positions are the same in the slide direction and at least two columns of the notch columns are offset in phase are described, but the invention is not limited to this combination. Even with the configuration of any one of combinations in which all the notch columns are the same in phase and at least two engaging protrusions are offset in position in the slide direction, the same operation and advantageous effects are basically obtained.

In addition, in the above description, the embodiments in which the invention is applied to the ink jet recording apparatus are described. However, the invention may also be applied to a liquid ejecting apparatus that feeds a liquid ejected target material as in the case of the above.

The invention claimed is:

1. A recording material feeding device comprising:

a recording material mounting face portion on which recording materials are stacked for being fed;

a movable edge guide that includes a body slide portion that is attached to the recording material mounting face portion so as to be slidable in a widthwise direction or in a feeding direction of the recording material, and a body operating portion having a guide face that contacts a side of the recording material while being fed; and a fixing means that fixes a position of the movable edge guide in a slide direction of the movable edge guide, wherein the fixing means includes:

notch columns that are provided on a surface of the recording material mounting face portion along the slide direction of the movable edge guide;

engaging protrusions that are provided on the movable edge guide and that engage notches of the notch columns, and a guide salient portion that is located at the downstream side of the body slide portion in the feeding direction and guides the recording material, wherein the body slide portion includes a plurality of slits arranged in a vertical direction from a top edge of the movable edge guide to a bottom edge, wherein the guide salient portion is positioned below the one of the plurality of slits closest to the bottom edge of the movable edge guide, wherein the guide salient portion guides an end side portion, which is a distal end in an advancing direction when the recording material advances in the reverse direction at the time when the recording material is returned in the reverse direction of a transport direction, in a direction away from an outer surface of a plate-like portion of the body slide portion, and wherein the recording material feeding device is configured according to any one of a combination in which at least two of the notch columns are offset in phase and a combination in which all of the notch columns are the same in phase and at least two of the engaging protrusions are offset in position in the slide direction.

2. The recording material feeding device according to claim 1, wherein:

the engaging protrusions of the movable edge guide are respectively provided on free end sides of separated elastic pieces that are separated by providing the slits in the plate-like portion of the body slide portion, and wherein the movable edge guide further includes an engaging/disengaging means that switches between an engaged state in which the engaging protrusions are engaged with the notches and a disengaged state in which the engaging protrusions are disengaged from the notches by applying force that bends the separated elastic pieces.

3. The recording material feeding device according to claim 2, wherein the outer surface of the plate-like portion of the body slide portion is configured to function as a recording material mounting surface on which the recording materials are mounted.

4. The recording material feeding device according to claim 3, wherein other guide salient portion(s) is/are provided on the downstream side(s) of the other slit(s).

5. The recording material feeding device according to claim 2, wherein the slits are provided so as to be inclined relative to the slide direction.

6. The recording material feeding device according to claim 5, wherein the slits are inclined in such an orientation that the free end sides of the separated elastic pieces are positioned upstream in a transport direction of the recording material beyond proximal end sides of the separated elastic pieces.

7. The recording material feeding device according to claim 1, wherein a plurality of the notch columns are formed, each of the notch columns beings formed to have the notches at the same pitch.

8. The recording material feeding device according to claim 1, wherein the engaging protrusions are provided separately for the respective notch columns, while the engaging protrusions are located at the same position in the slide direction.

9. The recording material feeding device according to claim 1, wherein the recording material feeding device is configured according to any one of a combination in which at least two of the notch columns are offset in phase and a combination in which all of the notch columns are the same in phase and at least two of the engaging protrusions are offset in position in the slide direction.

* * * * *